US006869910B2

(12) United States Patent
Williams et al.

(10) Patent No.: US 6,869,910 B2
(45) Date of Patent: Mar. 22, 2005

(54) IMAGE TRANSFER MATERIAL WITH IMAGE RECEIVING LAYER AND HEAT TRANSFER PROCESS USING THE SAME

(75) Inventors: Scott A. Williams, Hawley, PA (US); Anne Hermetet Agler, Hawley, PA (US)

(73) Assignee: Foto-Wear, Inc., Olyphant, PA (US)

( * ) Notice: Subject to any disclaimer, the term of this patent is extended or adjusted under 35 U.S.C. 154(b) by 0 days.

(21) Appl. No.: 10/205,628

(22) Filed: Jul. 26, 2002

(65) Prior Publication Data

US 2003/0008116 A1 Jan. 9, 2003

Related U.S. Application Data

(63) Continuation of application No. 09/672,827, filed on Sep. 29, 2000, now abandoned.

(60) Provisional application No. 60/220,199, filed on Jul. 24, 2000, and provisional application No. 60/157,018, filed on Oct. 1, 1999.

(51) Int. Cl.[7] ..... B41M 5/035; B41M 5/38

(52) U.S. Cl. ..... 503/227; 156/235; 428/32.12; 428/32.51

(58) Field of Search ..... 156/235; 428/32.12, 428/32.51; 583/227

(56) References Cited

U.S. PATENT DOCUMENTS

| | | | |
|---|---|---|---|
| 3,222,419 | A | 12/1965 | Jubilee et al. |
| 3,257,478 | A | 6/1966 | Jubilee et al. |
| 3,658,570 | A | 4/1972 | Crooks et al. |
| 3,936,542 | A | 2/1976 | Cox |
| 4,021,591 | A | 5/1977 | DeVries et al. |
| 4,189,395 | A | 2/1980 | Bland |
| 4,235,657 | A | 11/1980 | Greenman et al. |
| 4,284,456 | A | 8/1981 | Hare |
| 4,337,289 | A | 6/1982 | Reed et al. |
| 4,351,871 | A | 9/1982 | Lewis et al. |

(List continued on next page.)

FOREIGN PATENT DOCUMENTS

| | | |
|---|---|---|
| EP | 072801 A2 | 8/1996 |
| EP | 0820874 A1 | 1/1998 |
| EP | 1013466 A2 | 6/2000 |
| GB | 2202641 A | 9/1988 |
| WO | WO 9321561 | 10/1993 |
| WO | WO 9718090 | 5/1997 |
| WO | WO 9820393 | 5/1998 |
| WO | WO 9821398 | 5/1998 |
| WO | WO 0041891 A1 | 7/2000 |

OTHER PUBLICATIONS

English Abstract of JP 59210978 (Nov. 29, 1984).
English Abstract of JP 8324106 (Dec. 10, 1996).
English Abstract of JP 55135853 (Oct. 23, 1980).
English Abstract of JP 0948974 (Sep. 22, 1997).
English Abstract of JP 2147291 (Jun. 6, 1990).
English Abstract of JP 63071389 (Mar. 31, 1988).

*Primary Examiner*—Bruce Hess
(74) *Attorney, Agent, or Firm*—Birch, Stewart, Kolasch & Birch, LLP

(57) ABSTRACT

An image transfer sheet, having a support sheet, an optional barrier layer on the support sheet, at least one heat release layer on the optional barrier layer or on the support sheet, an image receiving layer on the heat release layer, an optional image layer on the image receiving layer, an optional non-water-dispersible polymer layer on the image layer, and an optional transfer blocking overcoat layer on the optional polymer layer or the image layer, is used in a dry heat transfer process to transfer an image to a receptor element. The image receiving layer of the present invention is a precipitated calcium carbonate (PCC)-containing image receiving layer, a polyvinylpyrrolidone (PVP)-containing image receiving layer, or an image receiving layer containing both PCC and PVP (PCC/PVP).

42 Claims, 3 Drawing Sheets

U.S. PATENT DOCUMENTS 4,477,622 A 10/1984 Sanderson et al.
4,555,436 A 11/1985 Geurtsen et al.
4,567,114 A 1/1986 Oshima et al.
4,726,979 A 2/1988 Chapman
4,773,953 A 9/1988 Hare
4,863,781 A 9/1989 Kronzer
4,869,957 A 9/1989 Vankerckhoven et al.
4,966,815 A 10/1990 Hare
4,980,224 A 12/1990 Hare
5,019,475 A 5/1991 Higashiyama et al.
5,096,876 A * 3/1992 Jahn et al. ..... 503/227
5,104,719 A 4/1992 Kamen et al.
5,139,917 A 8/1992 Hare
5,163,247 A 11/1992 Weber et al.
5,236,801 A 8/1993 Hare
5,242,739 A 9/1993 Kronzer et al.
5,242,781 A 9/1993 Ohbayashi et al.
5,271,990 A 12/1993 Kronzer et al.
5,366,837 A 11/1994 Sakai
5,370,132 A 12/1994 Weber et al.
5,441,056 A 8/1995 Weber et al.
5,501,902 A 3/1996 Kronzer
5,603,996 A 2/1997 Overcash et al.
5,612,168 A 3/1997 Ishikawa
5,620,548 A 4/1997 Hare
5,665,476 A 9/1997 Oez
5,670,448 A * 9/1997 Kometani ..... 503/227
5,678,247 A 10/1997 Vickers
5,741,387 A 4/1998 Coleman
5,766,398 A 6/1998 Cahill et al.
5,798,179 A 8/1998 Kronzer
5,851,651 A 12/1998 Chao
5,882,388 A 3/1999 Adair et al.
5,925,712 A 7/1999 Kronzer

* cited by examiner

IMAGE TRANSFER MATERIAL WITH IMAGE RECEIVING LAYER AND HEAT TRANSFER PROCESS USING THE SAME

This application is a continuation of application Ser. No. 09/672,827, filed on Sep. 29, 2000, now abandoned which is a conversion of provisional application Nos. 60/220,199 filed Jul. 24, 2000 and 60/157,018 filed Oct. 1, 1999, the entire contents of which are hereby incorporated by reference.

BACKGROUND OF THE INVENTION

1. Field of the Invention

The present invention relates to an image transfer material, and a process for printing images using toner, pigmented, and/or water soluble colorants from a heat transferable material having an image receiving layer, which image receiving layer contains 1) precipitated calcium carbonate (PCC), 2) polyvinylpyrrolidone (PVP), or 3) a combination of PCC and PVP (PCC/PVP). More specifically, the present invention relates to an image transfer sheet which can be applied to a receptor element, such as cotton or cotton/polyester blend fabrics or the like.

2. Description of the Prior Art

Textiles such as shirts (e.g., tee shirts) having a variety of designs thereon have become very popular in recent years. Many shirts are sold with pre-printed designs to suit the tastes of consumers. In addition, many customized tee shirt stores are now in the business of permitting customers to select designs or decals of their choice. Processes have also been proposed which permit customers to create their own designs on transfer sheets for application to tee shirts by use of a conventional hand iron, such as described in U.S. Pat. No. 4,244,358. Furthermore, U.S. Pat. No. 4,773,953, is directed to a method for utilizing a personal computer, a video camera or the like to create graphics, images, or creative designs on a fabric. These designs may then be transferred to the fabric by way of an ink jet printer, a laser printer, or the like.

Other types of heat transfer sheets are known in the art. For example, U.S. Pat. No. 5,798,179 is directed to a printable heat transfer material using a thermoplastic polymer such as a hard acrylic polymer or poly(vinyl acetate) as a barrier layer, and has a separate film-forming binder layer. U.S. Pat. No. 5,271,990 relates to an image-receptive heat transfer paper which includes an image-receptive melt-transfer film layer comprising a thermoplastic polymer overlaying the top surface of a base sheet. U.S. Pat. No. 5,502,902 relates to a printable material comprising a thermoplastic polymer and a film-forming binder. U.S. Pat. No. 5,614,345 relates to a paper for thermal image transfer to flat porous surfaces, which contains an ethylene copolymer or a ethylene copolymer mixture and a dye-receiving layer.

Other examples of heat transfer materials are disclosed by, for example, U.S. application Ser. No. 09/541,083 filed Mar. 31, 2000 which relates to relates to a polymeric composition comprising an acrylic dispersion, an elastomeric emulsion, a plasticizer, and a water repellant. U.S. application Ser. No. 09/557,173 filed Apr. 21, 2000 relates to a barrier layer. The barrier layer of Ser. No. 09/557,173 provides for "cold peel," "warm peel" and "hot peel" applications and comprises thermosetting and/or ultraviolet (UV) curable polymers. Provisional application 60/134,849, filed May 19, 1999 relates to a transferable material having a transfer blocking overcoat and to a process using said heat transferable material having a transfer blocking overcoat. The transfer blocking overcoat of 60/134,849 allows for the reduction of the polymer halo around the transferred image while still providing for the "hand" or feel of the substrate after transferring.

Some of the above-mentioned applications contain specific systems for forming clear images which are subsequently transferred onto the receptor element. However, other heat transfer systems exist, for example, those disclosed by U.S. Pat. Nos. 4,021,591, 4,555,436, 4,657,557, 4,914,079, 4,927,709, 4,935,300, 5,322,833, 5,413,841, 5,679,461, and 5,741,387.

However, one problem with many known transfer sheets is poor image quality of the printed images. Poor image quality can result when using any conventional printing process, such as, for example, ink jet printing, laser printing, lithographic offset printing, and any standard surface-to-surface printing processes. The present invention corrects this problem.

Some examples of poor image quality include fuzzy edges, mottled image areas and/or faded images which may sometimes occur in an ink jet application of an image area onto a conventional sheet substrate. These properties result due to the fact that the thermal ink jet process applies a dilute aqueous ink onto the surface of the recording paper by heating a small volume of the ink in a small chamber with an orifice that is directed at the recording paper. The small volume of ink that is heated rapidly reaches its boiling point, and the steam bubble formed propels a tiny drop of liquid ink at the paper, where the drop produces a single dot in a dot matrix that forms a character or image on the sheet. This process requires an ink that is low in solids and high boiling components so that it is capable of boiling rapidly without leaving a residue that can foul the heating element, and clog the orifice. Therefore, up to 96% of conventional ink jet printer ink is a mixture of water and low molecular weight glycols. Although such an ink boils quickly when heated to ensure rapid printing, and is not prone to clog, it results in an applied ink that is very mobile and slow to dry. Therefore, good print quality can be obtained only if the ink colorant or dye remains on or near the outer surface of the paper, and does not spread or move from the point at which it was applied. Accordingly, when these images are transferred onto a receptor element such as a T-shirt, the poor image quality is reproduced in the final product.

The prior art has attempted to address this problem of poor ink/paper substrate interaction and/or high ink absorption into the paper substrate. For example, several references discuss the use of an image receiving layer upon which the image is deposited. However, current systems are generally provided with a coating in which the pigment is a finely divided silica. However, these systems are unable to solve the problem associated with poor ink/paper interaction and/or high ink absorption into the paper substrate. Thus, the image transferred to the receptor element is flawed.

Accordingly, there continue to exist problems associated with transferring an image to a substrate, wherein the image is of good quality, having sharp edges, dense coloring and no mottled image areas. The present inventors have found that these problems may be solved by utilizing the image receiving layer according to the present invention.

SUMMARY OF THE INVENTION

In order to attract the interest of consumer groups that are already captivated by the tee shirt rage described above, the present invention provides, in one embodiment, an improved transfer sheet. In another embodiment, the present invention provides for a process of dry heat transfer of images to receptors. A unique advantage of the present invention is that it allows for the formation of images having sharp edges, dense coloring and no mottled image areas on an image transfer element, as well as the subsequent transfer of these images onto a receptor element. The transferred image retains the sharp edges, dense coloring and absence of mottled areas of the originally formed image. Thus, the present invention enables all consumers to wear and display apparel carrying designs that were formed on the transfer material and by the process of the present invention in a timely and cost efficient manner.

Accordingly, the present invention relates to a transfer material and a process for printing images using toner, pigmented, and/or water soluble colorants from a heat transferable material having an image receiving layer.

The present invention relates to a transfer sheet, comprising: a support sheet having a first and a second surface; at least one release layer on the first surface of the support sheet; and an image receiving layer on the release layer(s).

The present invention provides for three types of image receiving layers: 1) a PCC-containing image receiving layer, 2) a PVP-containing image receiving layer, and 3) a PCC/PVP-containing image receiving layer.

The present invention further provides for an optional barrier layer between the first surface of the support sheet and the release layer(s).

Additionally, the present invention provides for an image layer on the image receiving layer. The image layer comprises image and non-images areas.

The present further provides for an image layer as described above as well as a non-water-dispersible polymer layer on the image layer, and a transfer blocking overcoat layer on the non-water-dispersible polymer layer. In this particular embodiment, the transfer blocking overcoat layer outlines at least one imaged area or selected imaged areas in the image layer, but does not cover the imaged area within the outline. The transfer blocking overcoat layer allows transfer of only the release layer, the image areas of the image layer and the non-water-dispersible polymer layer within the outlined image area. The transfer blocking overcoat layer and non-water dispersible polymer layer or combinations thereof are described in Provisional Application 60/134,849 filed on Apr. 19, 1999, herein incorporated by reference.

The present invention further provides for an antistatic layer on the second surface of said support sheet.

In the PCC-containing image receiving layer embodiment, the PCC-containing image receiving layer comprises precipitated calcium carbonate, and optionally a binder. In this embodiment, the PCC-containing image receiving layer comprises about 20 to about 100%, preferably about 50 to about 95% by weight of said precipitated calcium carbonate, based on total weight of the PCC-containing image receiving layer, and about 0 to about 80%, preferably about 5 to about 50% by weight of said binder, based on the total weight of the PCC-containing image receiving layer.

In the PCC-containing image receiving layer embodiment, the PCC-containing image receiving layer has a dry coat weight of about 1 to about 40 g/m$^2$, preferably about 1 to about 20 g/m$^2$, more preferably about 1 to about 10 g/m$^2$.

In the PCC-containing image receiving layer embodiment, the PCC-containing image receiving layer has a dry coat thickness of about 0.01 to about 5 mils, preferably about 0.01 to about 2 mils, more preferably about 0.1 mils to about 1.5 mils.

In the PVP-containing image receiving layer embodiment, the PVP-containing image receiving layer comprises polyvinylpyrrolidone (PVP), and optionally a binder. The PVP is contained in an amount of about 20% to about 100% by weight, preferably about 40 to about 95% by weight, more preferably about 75 to about 95% by weight, based on the total weight of the image receiving layer. The binder is contained in an amount of about 0 to about 80% by weight, preferably about 0.1 to about 60% by weight most preferably about 0.1 to about 30% by weight, based on the total weight of the image receiving layer.

In the PVP-containing image receiving layer embodiment, the PVP-containing image receiving layer has a dry coat weight of about 1 to about 100 g/m$^2$, preferably about 2 to about 50 g/m$^2$, more preferably about 2 to about 30 g/m$^2$.

In the PVP-containing image receiving layer embodiment, the PVP-containing image receiving layer has a dry coat thickness of about 0.05 to about 2 mils, preferably about 0.1 to about 2.0 mils, more preferably about 0.1 to about 1.0 mils.

In the PCC/PVP-containing image receiving layer embodiment, the PCC/PVP-containing image receiving layer comprises precipitated calcium carbonate (PCC), polyvinylpyrrolidone (PVP), and optionally a binder. The PCC is contained in an amount of about 0.1 to about 95% by weight, preferably about 5 to about 85% by weight, more preferably about 30 to about 70% by weight, based on the total weight of the image receiving layer. The PVP is contained in an amount of about 5 to about 99.9% by weight, preferably about 10 to about 95% by weight, more preferably about 20 to about 85% by weight, based on the total weight of the image receiving layer. The binder is contained in an amount of about 0 to about 80% by weight, preferably about 1 to about 80% by weight, more preferably about 5 to about 40% by weight, most preferably about 5 to about 25% by weight, based on the total weight of the image receiving layer.

In the PCC/PVP-containing image receiving layer embodiment, the PCC/PVP-containing image receiving layer has a dry coat weight of about 1 to about 100 g/m$^2$, preferably about 2 to about 50 g/m$^2$, more preferably about 2 to about 30 g/m$^2$.

In the PCC/PVP-containing image receiving layer embodiment, the PCC/PVP-containing image receiving layer has a dry coat thickness of about 0.05 to about 2 mils, preferably about 0.1 to about 2.0 mils, more preferably about 0.2 to about 1.5 mils.

The different image receiving layers of the present invention are also applicable to imaging sheets without transfer capability. For instance, the present invention also relates to a support sheet coated with 1) a PCC-containing image receiving layer, 2) a PVP-containing image receiving layer, or 3) a PCC/PVP-containing image receiving layer of the present invention.

The present invention further provides for a process for heat transferring an imaged area from a transfer sheet to a receptor element (such as a tee shirt). In the process, the receptor element is placed in contact with the image layer of an image transfer sheet according to the present invention. Next, heat and pressure are applied to the second surface of the support sheet (back surface). Upon heating, the image layer, the image receiving layer, and the heat release layer are thermally transferred through the transfer blocking overcoat onto and/or into the receptor. The support is then allowed to optionally cool before removing from the receptor. When the support is not allowed to cool prior to removing the support, this is known as "hot-peel."

BRIEF DESCRIPTION OF THE DRAWINGS

The present invention will become more fully understood from the detailed description given hereinbelow, and the accompanying drawings that are given by way of illustration only and thus are not limitive of the present invention, and wherein:

FIG. 3 illustrates the step of ironing the transfer element of the present invention onto a tee shirt or the like.

DETAILED DESCRIPTION OF THE INVENTION

Figure 1:
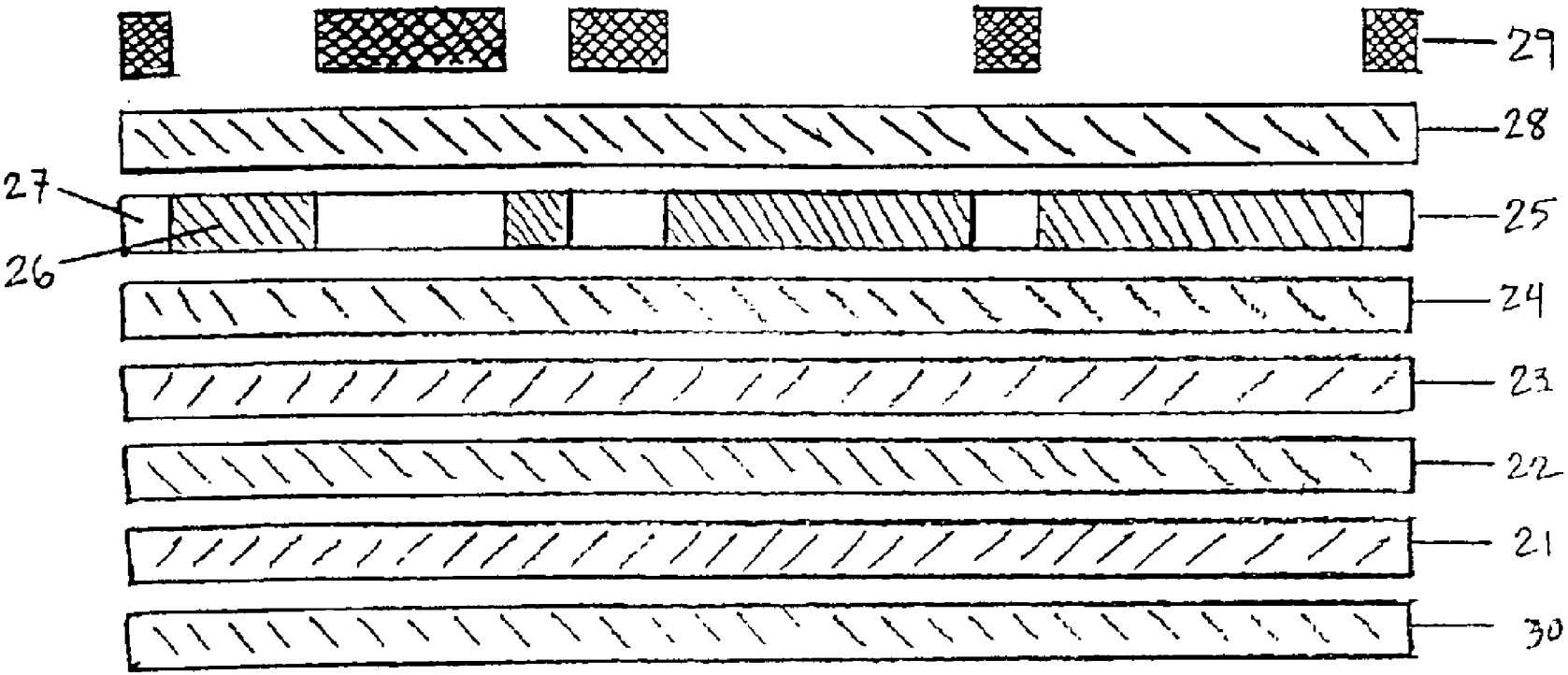
FIG. 1 is a cross-sectional view of one embodiment of the transfer element of the present invention.

The present invention includes a thermal transfer sheet and a transfer method for transferring the image area from said thermal transfer sheet to a receptor element.

The transfer sheet of the present invention includes a support, a heat release polymer layer, an image receiving layer and an optional image layer.

The present invention provides for three types of image receiving layers: 1) a PCC-containing image receiving layer, 2) a PVP-containing image receiving layer, and 3) a PCC/PVP-containing image receiving layer.

The present invention also provides for optional layers such as an image layer, a barrier layer, a transfer blocking overcoat layer, a non-water dispersible polymer layer, and an antistatic layer.

The present invention also provides for a kit containing the transfer sheet of the present invention and instructions for transferring an image thereon. The kit may also optionally contain markers, paint, crayons, tee-shirts, prep-shirts and other design aids.

The present invention further provides for a method of heat transferring each of the above image layers from the transfer sheet to a receptor element. In this process, the receptor element is placed in contact with the outermost layer, for example, the image layer, and heat is applied preferably through the support, whereupon the optional non-water dispersible polymer layer, the image layer, the image receiving layer, and the heat release layer, are thermally transferred onto and/or into the receptor element.

A. The Transfer Material

1. Support

The support is a thin flexible, but non-elastic carrier sheet upon which the release layer can be formed and serves as a support for the production of an image on the transfer material and from which the image can be released. The support is not particularly limited and may be any conventional support sheet which is suitably flexible and upon which the heat release layer, image receiving layer, and optional image layer can be formed. Typically, the support sheet is a paper web, plastic film, metal foil, wood pulp fiber paper, vegetable parchment paper, lithographic printing paper or similar material.

In one embodiment of the present invention the support provides a surface that will promote or at least not adversely affect image adhesion and image release to the receptor. An appropriate support material may include but is not limited to a cellulosic nonwoven web or film, such as a smooth surface, heavyweight (approximately 24 lb.) laser printer or color copier paper stock or laser printer transparency (polyester) film. However, highly porous supports are less preferred because they tend to absorb large amounts of the coating and/or toner in copiers without providing as much release. The particular support used is not known to be critical, so long as the substrate has sufficient strength for handling, copying, coating, heat transfer, and other operations associated with the present invention. Accordingly, in accordance with some embodiments of the present invention, the support may be the base material for any printable material, such as described in U.S. Pat. No. 5,271,990.

2. The Optional Barrier Layer

The barrier layer is coated on the support and assists in releasing the image layer. Any suitable barrier layer known in the art may be used as the barrier layer of the present invention. Suitable but non-limiting barrier layers include the barrier layers disclosed in U.S. application Ser. No. 09/541,083, filed Mar. 31, 2000, Ser. No. 09/557,173, filed Apr. 21, 2000, and U.S. Pat. Nos. 5,501,902, 5,271,990, 5,242,739 and 5,798,179, which are herein incorporated by reference.

In one embodiment, the barrier layer comprises a polymer dispersion. For example, the polymer dispersion may comprise one or more of the components selected from the group consisting of polyacrylates, styrene-butadiene copolymers, ethylene-vinyl acetate copolymers, nitrile rubbers, poly(vinylchloride), poly(vinylacetate) and ethylene-acrylate copolymers. Preferably, the polymer dispersion comprises polyvinyl acetate dibutyl maleate copolymer.

In another embodiment, the barrier layer may comprise a polymer selected from the group consisting of a thermosetting polymer, an ultraviolet curable polymer, and combinations thereof, or the barrier layer may comprise acetone, 2-propanol, and polymethyl methacrylate. The thermosetting polymer is preferably selected from the group consisting of thermosetting acrylic polymers and blends; thermosetting polyurethanes, block polyurethanes and aromatic-functional urethanes; thermosetting polyester polymers and co-polymer systems; aromatic-functional vinyl polymers and polymer blends; and thermosetting epoxy resins.

Materials that fall into the class of thermosetting polymers should function as either a cool, hot or warm peel barrier layer of the present invention. Thermosetting polymers are both chemically and physically distinct from thermoplastic polymers, which, among other properties, flow upon the addition of heat energy. The fact that the thermosetting material polymerizes to form a layer which cannot be re-melted and flow with heat energy imparts both a hot and cold peel release property. That is, the thermosetting material of the barrier layer of the present invention will not undergo a temperature dependent physical state change. Such a temperature physical state change can produce, among other properties, a tack that could provide a physical adherence of the release layer to the support base.

Thermosetting materials include thermosetting acrylic polymers and blends, such as hydroxyl-functional acrylic polymers and carboxy-functional acrylic polymers and vinyl acrylic polymer blends; thermosetting polyurethanes, block polyurethanes and aromatic-functional urethanes; thermosetting polyester polymers and co-polymer systems such as neopentyl glycol isophthalic polyester resins, dibromoneopentyl glycol polyester resins and vinyl ester resins; aromatic-functional vinyl polymers and polymer blends; and thermosetting epoxy resins, in particular, epoxy novolac resins. Generally, the thermosetting polymer system(s) must undergo crosslinking reaction(s) over a range of temperatures from, for example 100° to 250° C. over a period of less than thirty (30) minutes.

Coating weights may range from one(1) gram per meter square to 20 grams per meter square, preferably from 1 $g/m^2$ to 15 $g/m^2$, most preferably 1 $g/m^2$ to 8 $g/m^2$.

For a description of suitable thermosetting polymers, see pages 10 to 13 of *Polymer Chemistry, an Introduction*, Malcolm P. Stevens, 1990; and pages 113 and 299 of *Textbook of Polymer Science*, Fred W. Billmeyer, Jr., 1962.

The barrier layer also may optionally include an effective amount of a release-enhancing additive for assisting in release of the release layer from the barrier during peeling, including but not limited to divalent metal ion salts of a fatty acids, polyethylene glycols, silicones and siloxanes, or mixtures thereof. The release-enhancing additive may be present in an amount of from 0.001 to 40% by weight, preferably 0.01 to 20% by weight, most preferably 0.01 to 5% by weight. For example, the release-enhancing additive may be calcium stearate, a polyethylene glycol having a molecular weight of from about 2,000 to about 100,000, or a mixture thereof.

Preferably, the barrier layer is any vinyl acetate with a Tg in the range of from about −10° C. to 100° C. Alternatively, the Tg may be in the range of from about 0° C. to 100° C. EVERFLEX G, with a Tg of about −7°, may be used as a preferred embodiment.

Ultraviolet curable/setting materials may be used as the barrier layer of the present invention. UV setting materials can be divided into two classes based upon the mechanism by which they set. The first class of ultraviolet curing/setting materials set via a cationic mechanism while the second class sets via a free radical mechanism. It is important to note, however, that a number of ultraviolet curing systems incorporate both classes into a single formulation, typically termed a hybrid resin system. In one embodiment of the present invention, the ultraviolet curing system, especially when comprising cationic systems, may incorporate thermosetting polymers, thereby resulting in systems that typically are cured initially by ultraviolet activation, then further cured by exposure to a heat source. In such an embodiment, the final coated surface has the best properties of both thermosetting and ultraviolet setting systems. As a consequence of such multiple pathways to create the final cured coating, the ultraviolet setting compounds to be listed herein may be activated by any combination of the mechanisms described herein.

Furthermore, the thermosetting or UV curable barrier layer of the present invention may be combined with at least one vinyl acetate polymer. One of ordinary skill in the art would recognize the appropriate mechanism or mechanisms by which to activate a specific formulation of ultraviolet curing compounds and formulations that include both ultraviolet curing compounds and thermosetting compounds.

Typical formulations of ultraviolet curable systems are composed of primary resins, which provide the major film-forming properties; modifying resins, which modify the film properties to meet specifications for the application in which it is to be used; additives, which provide or enhance specific properties of the film; and photoinitiators which, when exposed to an ultraviolet radiation source, begin the cross-linking reaction that cures the system. The UV curable polymers of the present invention are typically cured at <50 $mJ/cm^2$ with a mercury vapor ultraviolet lamp.

Primary and modifying resins are discussed as a single class as they often cross over from one application to the next. These ultraviolet curable resins include, but are not limited to monomers and oligomers. Monomers such as monofunctional monomers including acrylates, methacrylates, and ethylacrylates; difunctional monomers including various diacrylates and dimethacrylates, especially tripropylene glycol diacrylate, bisphenol A diacrylates and ethoxylated bisphenol A dimethacrylates; trifunctional monomers including various triacrylates and trimethacrylates, especially trimethylolpropane ethoxy triacrylate and trimethyl propane triacrylates; higher functionality monomers including tetra- and pentaacrylates and pentaacrylate esters; aliphatic and aromatic acrylates; aromatic urethane acrylates; metallic acrylates; water dispersible monomers such as, for example, 2(2-ethoxyethoxy) ethylacrylate and polyethylene glycol diacrylates; adhesion promoting monomers such as various acrylate esters and methacrylate esters; pigment dispersing monomers; and scorch retarding monomers.

Oligomers such as aliphatic urethane acrylates; aliphatic urethane diacrylates; aliphatic urethane triacrylates; hexafunctional aliphatic urethane acrylates; hexafunctional aromatic urethane acrylates; trifunctional aromatic urethane acrylates, aromatic urethane acrylates; urethane methacrylates; epoxy acrylates; epoxy methacrylates; polybutadiene dimethylacrylates; diacrylates of bisphenol-A epoxy resins; modified bisphenol-A epoxy acrylate resins; novolac epoxy acrylates; modified epoxy acrylates, partially acrylated bisphenol-A epoxy resins; bisphenol-A epoxy diacrylates; polyester resins including chlorinated polyester resins, modified polyester resins, polyester methacrylates, acrylated polyesters, modified polyester acrylates, modified polyester hexaacrylates, polyestertetracrylates, and hexafunctional polyester acrylates; cycloaliphatic epoxideresins, especially 3,4-epoxycyclohexyl-methyl-3,4,-epoxycyclohexame carboxylate; modified cycloaliphatic epoxides, especially acrylate modified cycloaliphatic epoxides containing both acrylate and epoxy functionalities; aliphatic polyols; partially acrylated bisphenol-A epoxy resins; and cycloaliphatic diepoxides.

Photoinitiators for the ultraviolet curable systems include, but are not limited to alpha hydroxy ketone; benzil dimethyl ketal; benzoin normal butyl ethers; benzophenone; modified benzophenones; polymeric hydroxy ketones; trimethylbenzophenone blends; sulfonium, iodonium, ferrocenium or diazonium salts, especially cyclic 1,2-propylene carbonate bis-p-diphenylsulfoniumphenylsulfide hexafluorophosphate, and diphenylsulfonium hexafluorophosphate; peroxides; cobaloximes and related cobalt (II) complexes; and organic photoinitiators such as, for example, 2,2-diethoxyacetophenone, ethyl 4-(dimethylamino) benzoate, methyldiethanolamine, isopropylthioxanthone, and especially 2-hydroxy-2-methyl-1-phenyl-1-propanone.

Additives that may be used in the above-described ultraviolet curable systems include, but are not limited to photoinitiator activators; slip agents; leveling agents; wetting agents; adhesion promoters; anti-absorption agents; anti-foaming agents, especially mixtures of foam destroying polymers and polysiloxanes; accelerators; pigment dispersion aids; anti-blocking agents; anti-caking agents; anti-slip agents; anti-skinning agents; anti-static agents; anti-stripping agents; binders; curing agents; crosslinking agents; deaerators; diluents; dispersants; dryers; emulsifiers; fillers; flatting agents; flow control agents; gloss agents; hardeners; lubricants; mar resistance aids; whiteners; plasticizers; solvents; stabilizers; surfactants; viscosity modifiers; UV stabilizers; UV absorbers; and water repellants. The barrier layer of the present invention may also comprise the crosslinking polymers of U.S. Pat. No. 5,603,996 to Overcash et al. Specifically, see Overcash et al. at cols. 5–8.

The barrier layer may comprise an acrylic polymer, or resin, as a cross-linkable polymer. Additional cross-linkable acrylic polymers include MICHEM COAT 50A, made by Michelman, Inc., and RHOPLEX.RTM. P-376 and RHOPLEX.RTM. B-15, made by Rohm and Haas. In addition, styrene-butadiene resins, or polymers, ("SBR") are suitable as cross-linkable polymers in the barrier coating composition, including such SBR's as MICHEM COAT 50H, made by Michelman, Inc., and Latex PB 6692NA made by Dow Chemical. Blends and/or copolymers of cross-linkable polymers may also be used. Other cross-linkable polymers, such as polyesters, especially polyethylene terephthalate, polyurethane polymers and various fluorochemical polymers (e.g., 3B ZONYL.RTM. 7040 made by Du Pont), may also provide the necessary barrier properties. Additionally, EvCote PWR-25 is a suitable heat crosslinked barrier layer.

A more specific listing of polymers that may be used as cross-linkable polymers includes, but is not limited to:

polymers and copolymers of poly(dienes) such as poly (butadiene), poly(isoprene), and poly(1-penetenylene);

poly(acrylics) such as poly(benzyl acrylate), poly(butyl acrylate) (s), poly(2-cyanobutyl acrylate), poly(2-ethoxyethyl acrylate), poly(ethyl acrylate), poly(2-ethylhexyl acrylate), poly(fluoromethyl acrylate), poly(5,5,6,6,7,7,7-heptafluoro-3-oxaheptyl acrylate), poly (heptafluoro-2-propyl acrylate), poly(heptyl acrylate), poly (hexyl acrylate), poly(isobornyl acrylate), poly(isopropyl acrylate), poly(3-methoxybutyl acrylate), poly(methyl acrylate), poly(nonyl acrylate), poly(octyl acrylate), poly (propyl acrylate), and poly(p-tolyl acrylate);

poly(acrylamides) such as poly(acrylamide), poly(N-butylacrylamide), poly(N,N-dibutylacrylamide), poly(N-dodecylacrylamide), and poly(morpholylacrylamide);

poly(methacrylic acids) and poly(methacrylic acid esters) such as poly(benzyl methacrylate), poly(octyl methacrylate), poly(butyl methacrylate), poly(2-chloroethyl methacrylate), poly(2-cyanoethyl methacrylate), poly (dodecyl methacrylate), poly(2-ethylhexyl methacrylate), poly(ethyl methacrylate), poly(1,1,1-trifluoro-2-propyl methacrylate), poly(hexyl methacrylate), poly(2-hydroxyethyl methacrylate), poly(2-hydropropyl methacrylate), poly(isopropyl methacrylate), poly (methacrylic acid), poly(methyl methacrylate) in various forms such as, atactic, isotactic, syndiotactic, and heterotactic; and poly(propyl methacrylate);

poly(methacrylamides) such as poly(4-carboxy phenylmethacrylamide);

other alpha-and beta-substituted poly(acrylics) and poly (methacrylics) such as poly(butyl chloracrylate), poly(ethyl ethoxycarbonylmethacrylate), poly(methyl fluoroacrylate), and poly(methyl phenylacrylate);

poly(vinyl ethers) such as poly(butoxyethylene), poly (ethoxyethylene), poly(ethylthioethylene), (dodecafluorobutoxyethylene), poly poly(2,2,2-trifluoroethoxytrifluoroethylene), poly(hexyloxyethylene), poly(methoxyethylene), and poly(2-methoxypropylene);

poly(vinyl halides) and poly(vinyl nitriles) such as poly (acrylonitrile), poly(1,1-dichloroethylene), poly (chlorotrifluoroethylene), poly(1,1-dichloro-2-fluoroethylene), poly(1,1-difluoroethylene), poly (methacrylonitrile), poly(vinyl chloride), and poly (vinylidene chloride);

poly(vinyl esters) such as poly(vinyl acetate), poly (benzoyloxyethylene), poly(4-butyryloxybenzoyloxyethylene), poly(4-ethylbenzoyloxyethylene), poly [(trifluoroacetoxy)ethylene], poly[(heptafluorobutyryloxy) ethylene], poly(formyloxyethylene), poly[(2-methoxybenzoyloxy)ethylene], poly(pivaloyloxyethylene), and poly(propionyloxyethylene);

poly(styrenes) such as, poly(4-acetylstyrene), poly[3-(4-biphenylyl)styrene], poly(4-[(2-butoxyethoxy) methyl] styrene), poly(4-butoxymethyl styrene), poly(4-butoxystyrene), poly(4-butylstyrene), poly(4-chloro-2-methylstyrene), poly(2-chlorostyrene), poly(2,4-dichlorostyrene), poly(2-ethoxymethyl styrene), poly(4-ethoxystyrene), poly(3-ethylstyrene), poly(4-fluorostyrene), poly(perfluorostyrene), poly(4-hexylstyrene), poly [4-(2-hydroxyethoxymethyl)styrene], poly [4-(1-hydroxy-1-methylpropyl)styrene], poly(2-methoxymethylstyrene), poly(2-methoxystyrene), poly(alpha-methylstyrene), poly (2-methylstyrene), poly(4-methoxystyrene), poly(4-octanoylstyrene), poly(4-phenoxystyrene), poly(4-phenylstyrene), poly(4-propoxystyrene), and poly(styrene);

poly(oxides) such as poly(ethylene oxides), poly (tetrahydrofuran), poly(oxetanes), poly(oxybutadiene), poly [oxychloromethyl)ethylene], poly(oxy-2-hydroxytrimethyleneoxy-1,4-phenylenemethylene-1,4-phenylene), poly(oxy-2,6-dimethoxy-1,4-phenylene), and poly(oxy-1,3-phenylene);

poly(carbonates) such as polycarbonate of Bisphenol A, and poly[oxycarbonyloxy-4,6-dimethyl]-1,2-phenylenemethylene-3,5-dimethyl-1,2-phenylene];

poly(esters) such as poly(ethylene terephthalate), poly[(1,2-diethoxycarbonyl)ethylene], poly[(1,2-dimethoxycarbonyl)ethylene], poly(oxy-2-butenyleneoxysebacoyl), poly [di(oxyethylene)oxyadipoyl], poly(oxyethyleneoxycarbonyl-1,4-cyclohexylenecarbonyl), poly(oxyethyleneoxyisophthaloyl), poly[di(oxyethylene)oxyoxalyl], poly[di (oxyethylene)oxysuccinyl], poly(oxyethyleneoxyterephthaloyl), poly(oxy-1,4-phenyleneisopropyiidene-1,4-phenylene oxysebacoyl), and poly(oxy-1,3-phenyleneoxyisophthaloyl);

poly(anhydrides) such as poly(oxycarbonyl-1,4-phenylenemethylene-1,4-phenyl enecarbonyl), and poly (oxyisophthaloyl); poly(urethanes) such as poly (oxycarbonyliminohexamethylene-iminocarbonyloxydecamethylene), poly(oxyethyleneoxycarbonyl-iminiohexamethyleneiminocarbonyl), poly(oxyethyleneoxycarbonylimino-1,4-phenylenetrimethylene-1,4-phenylene-iminocarbonyl), poly(oxydodecamethyleneoxycarbonyl-iminodecamethyleneiminocarbonyl), and poly (oxytetramethyleneoxycarbonylimino-1,4-phenylenemethylene-1,4-phenyleneiminocarbonyl);

poly(siloxanes) such as, poly(dimethylsiloxane), poly [oxy(methyl)phenylsilylene], and poly(oxydiphenylsilylene-1,3-phenylene);

poly(sulfones) and poly(sulfonamides) such as poly [oxycarbonyl di(oxy-1,4-phenylene)sulfonyl-1,4-phenyleneoxy-1,4-phenylene], poly[oxy-1,4-phenylenesulfinyl-1,4-phenyleneoxy-1,4-phenylenecarbonyl-1,4-phenylene), poly(oxy-1,4-phenylenesulfonyl-1,4-phenylene), and poly(sulfonyl-1,3-cyclohexylene);

poly(amides) such as nylon-6, nylon-6,6, nylon-3, nylon-4,6, nylon-5,6, nylon-6,3, nylon-6,2, nylon-6,12, and nylon-12;

poly(imines) such as poly(acetyliminoethylene), and poly (valeryl iminoethylene);

poly(benzimidazoles) such as poly(2,6-benzimidazolediyl-6,2-benzimidazolediyloctamethylene);

carbohydrates such as amylose triacetate, cellulose triacetate, cellulose tridecanoate, ethyl cellulose, and methylcellulose;

and polymer mixtures and copolymers thereof such as poly(acrylonitrile-co-styrene) with poly(e-caprolactone), or poly(ethyl methacrylate), or poly(methyl methacrylate);

poly (acrylonitrile-co-vinylidene chloride) with poly (hexamethylene terephthalate);

poly (allyl alcohol-co-styrene) with poly(butylene adipate), or poly(butylene sebacate); poly(n-amyl methacrylate) with poly(vinyl chloride);

bisphenol A polycarbonate with poly(e-caprolactone), or poly(ethylene adipate), or poly(ethylene terephthalate), or novolac resin;

poly(butadiene) with poly(isoprene);

poly(butadiene-co-styrene) with glycerol ester of hydrogenated rosin;

poly(butyl acrylate) with poly(chlorinated ethylene), or poly(vinyl chloride);

poly(butyl acrylate-co-methyl methacrylate) with poly (vinyl chloride);

poly(butyl methacrylate) with poly(vinyl chloride);

poly(butylene terephthalate) with poly(ethylene terephthalate), or poly(vinyl acetate-co-vinylidene chloride);

poly(e-caprolactone) with poly(chlorostyrene), or poly (vinyl acetate-co-vinylidene chloride);

cellulose acetate with poly(vinylidene chloride-co-styrene);

cellulose acetate-butyrate with poly(ethylene-co-vinyl acetate);

poly(chlorinated ethylene) with poly(methyl methacrylate);

poly(chlorinated vinyl chloride) with poly(n-butyl methacrylate), or poly(ethyl methacrylate), or poly (valerolactone);

poly(chloroprene) with poly(ethylene-co-methyl acrylate);

poly(2,6-dimethyl-1,4-phenylene oxide) with poly(a-methylstyrene-co-styrene styrene), or poly(styrene);

poly(ethyl acrylate) with poly(vinyl chloride-co-vinylidene chloride), or poly(vinyl chloride);

poly(ethyl methacrylate) with poly(vinyl chloride);

poly(ethylene oxide) with poly(methyl methacrylate);

poly(styrene) with poly(vinyl methyl ether); and poly(valerolactone) with poly(vinyl acetate-co-vinylidene chloride).

Another suitable barrier layer may be the release layer of U.S. Pat. No. 5,798,179 to Kronzer. The barrier layer may be composed of a thermoplastic polymer having essentially no tack at transfer temperatures (e.g., 60–220° C.), a solubility parameter of at least about 19 $(Mpa)^{1/2}$, and a glass transition temperature of at least about 0° C. As used herein, the phrase "having essentially no tack at transfer temperatures" means that the barrier layer does not stick to the polyester layer to an extent sufficient to adversely affect the quality of the transferred image. By way of illustration, the thermoplastic polymer may be a hard acrylic polymer or poly(vinyl acetate). For example, the thermoplastic polymer may have a glass transition temperature ($T_g$) of at least about 25° C. As another example, the $T_g$ may be in a range of from about 25° C. to about 100° C. The barrier layer also may include an effective amount of a release-enhancing additive, such as a divalent metal ion salt of a fatty acid, a polyethylene glycol, or a mixture thereof. For example, the release-enhancing additive may be calcium stearate, a polyethylene glycol having a molecular weight of from about 2,000 to about 100,000, or a mixture thereof.

Additionally, there are no primary or secondary changes of state upon heating that would alter the physical characteristics (such as, for example, surface residue) upon transfer. The barrier layer of the present invention preferably transfers no residue to the transferred image. The barrier layer preferably provides a water barrier that helps prevent penetration of the support.

In a preferred embodiment of the invention, the barrier layer is a vinyl acetate polymer. In another embodiment of the present invention, the barrier layer contains a polyester resin such as polymethyl methacrylate (PMMA) in a molecular weight range of from 15,000 to 120,000 Daltons.

The barrier layer may possess hot, warm and cold peel properties, such as when EVERFLEX G is used as part of the barrier layer. That is, after heat is applied to the transfer sheet and the image is transferred to the receptor, the transfer sheet may be peeled away from the receptor immediately after ironing (hot peel), before it is allowed to cool (i.e., warm peel), or alternatively, the transfer sheet is allowed to cool before it is peeled away from the receptor (i.e., cold peel).

By way of example, the barrier layer may comprise the following polymers which have suitable glass transition temperatures as disclosed in U.S. Pat. No. 5,798,179 to Kronzer:

| Polymer Type | Product Identification |
|---|---|
| Polyacrylates | Hycar ® 26083, 26084, 26120, 26104, 26106, 26322, B. F. Goodrich Company, Cleveland, Ohio<br>Rhoplex ® HA-8, HA-12, NW-1715, Rohm and Haas Company, Philadelphia, Pennsylvania<br>Carboset ® XL-52, B. F. Goodrich Company, Cleveland, Ohio |
| Styrene-butadiene copolymers | Butofan ® 4264, BASF Corporation, Sarnia, Ontario, Canada<br>DL-219, DL-283, Dow Chemical Company, Midland, Michigan |
| Ethylene-vinyl acetate copolymers | Dur-O-Set ® E-666, E-646, E-669, National Starch & Chemical Co., Bridgewater, New Jersey |
| Nitrile rubbers | Hycar ® 1572, 1577, 1570 × 55, B. F. Goodrich Company, Cleveland, Ohio |
| Poly (vinyl chloride) | Vycar ® 352, B. F. Goodrich Company, Cleveland, Ohio |
| Poly (vinyl Acetate) | Vinac XX-210, Air Products and Chemicals, Inc., Napierville, Illinois |
| Ethylene-acrylate copolymers | Michem ® Prime, 4990, Michelman, Inc., Cincinnati, Ohio<br>Adcote 56220, Morton Thiokol, Inc., Chicago, Illinois |

An additional embodiment of the barrier layer of the present invention is 100 parts (by weight) Polyester Resin (Polylite 32-737; Reichhold, Inc.). The polyester coating is applied with a dry coat weight of from 1 to 20 g/m$^2$, preferably 1–15 g/m$^2$ and most preferably 1–8 g/m$^2$. Coating methods include gravure, metered rod, air knife, cascade, etc. Coatings are cured by exposure to thermal energy that ranges from 30° C. to 250° C., preferably 70° C. to 200° C., and most preferably 120° to 170° C. Curing times range from 10 seconds to 20 minutes, preferably from 1 minute to 18 minutes, most preferably from 8 minutes to 15 minutes.

3. Optional Antistatic Layer

An antistatic layer may be coated on the back of the support. Any suitable antistatic layer known in the art may be used as the antistatic layer of the present invention. In accordance with one embodiment of the invention, the support is usable in a laser copier or laser printer. A preferred support for this embodiment is equal to or less than approximately 4.0 mils thick. The antistatic layer according to the present invention may have a solution viscosity of from 0.1 to 20 cP, preferably 1–5 cP, most preferably about 2 cP, as measured on a Brookfield DV-I+ viscometer, LV1 spindle at 60 rpm at a temperature of 25° C. Additionally, the antistatic layer may be wet coated in an amount of from 1 g/m$^2$ to 50 g/m$^2$, preferably from 10–30 g/m$^2$, most preferably about 18 g/m$^2$. The surface tension of the antistatic layer may be from 30–110 dynes/cm, preferably from 50–90 dynes/cm, most preferably about 70 dynes/cm as measured at room temperature.

Since this particular support is useable in a laser copier or laser printer, antistatic agents may be present. The antistatic agents may be present in the form of a coating on the back surface of the support as an additional layer. The back surface of the support is the surface that is not previously coated with the release layer, optional barrier layer, etc.

When the antistatic agent is applied as a coating onto the back surface of the support, the coating will help eliminate copier or printer jamming by preventing the electrostatic adhesion of the paper base to the copier drum of laser and electrostatic copiers and printers. Antistatic agents, or "antistats" are generally, but not necessarily, conductive polymers that promote the flow of charge away from the paper. Antistats can also be "humectants" that modulate the level of moisture in a paper coating that affects the build up of charge. Antistats are commonly charged tallow ammonium compounds and complexes, but also can be complexed organometallics. Antistats may also be charged polymers that have a similar charge polarity as the copier/printer drum; whereby the like charge repulsion helps prevent jamming.

Antistatic agents include, by way of illustration, derivatives of propylene glycol, ethylene oxide-propylene oxide block copolymers, organometallic complexes such as titanium dimethylacrylate oxyacetate, polyoxyethylene oxide-polyoxypropylene oxide copolymers and derivatives of cholic acid.

More specifically, commonly used antistats include those listed in the *Handbook of Paint and Coating Raw Materials*, such as t-Butylaminoethyl methacrylate; Capryl hydroxyethyl imidazoline; Cetethyl morpholinium ethosulfate; Cocoyl hydroxyethyl imidazoline Di(butyl, methyl pyrophosphato) ethylenetitanate di(dioctyl, hydrogen phosphite); Dicyclo (dioctyl)pyrophosphato; titanate; Di (dioctylphosphato) ethylene titanate; Dimethyl diallyl ammonium chloride; Distearyldimonium chloride; N,N'-Ethylene bis-ricinoleamide; Glyceryl mono/dioleate; Glyceryl oleate; Glyceryl stearate; Heptadecenyl hydroxyethyl imidazoline; Hexyl phosphate; N(β-Hydroxyethyl) ricinoleamide; N-(2-Hydroxypropyl) benzenesulfonamide; Isopropyl4-aminobenzenesulfonyl di(dodecylbenzenesulfonyl)titanate; Isopropyl dimethacryl isostearoyl titanate; isopropyltri(dioctylphosphato) titanate; Isopropyl tri (dioctylpyrophosphato)titanate; Isopropyl tri(N ethylaminoethylamino) titanate; (3-Lauramidopropyl) trimethyl ammonium methyl sulfate; Nonyl nonoxynol-15; Oleyl hydroxyethyl imidazoline; Palmitic/stearic acid mono/diglycerides; PCA; PEG-36 castor oil; PEG-10 cocamine; PEG-2 laurate; PEG-2; tallowamine; PEG-5 tallowamine; PEG-15 tallowamine; PEG-20 tallowamine; Poloxamer 101; Poloxamer 108; Poloxamer 123; Poloxamer 124; Poloxamer 181; Poloxamer 182; Poloxamer 184; Poloxamer 185; Poloxamer 188; Poloxamer 217; Poloxamer 231; Poloxamer 234; Poloxamer 235; Poloxamer 237; Poloxamer 282; Poloxamer 288; Poloxamer 331; Polaxamer 333; Poloxamer 334; Poloxamer 335; Poloxamer 338; Poloxamer 401; Poloxamer 402; Poloxamer 403; Poloxamer 407; Poloxamine 304; Poloxamine 701; Poloxamine 704; Polaxamine 901; Poloxamine 904; Poloxamine 908; Poloxamine 1107; Poloxamine 1307; Polyamide/epichlorohydrin polymer; Polyglyceryl-10 tetraoleate; Propylene glycol laurate; Propylene glycol myristate; PVM/MA copolymer; polyether; Quaternium-18; Slearamidopropyl dimethyl-β-hydroxyethyl ammonium dihydrogen phosphate; Stearamidopropyl dimethyl-2-hydroxyethyl ammonium nitrate; Sulfated peanut oil; Tetra (2, diallyoxymethyl-1 butoxy titanium di (di-tridecyl) phosphite; Tetrahydroxypropyl ethylenediamine; Tetraisopropyl di (dioctylphosphito) titanate; Tetraoctyloxytitanium di (ditridecylphosphite); Titanium di (butyl, octyl pyrophosphate) di (dioctyl, hydrogen phosphite) oxyacetate; Titanium di (cumylphenylate) oxyacetate; Titanium di (dioctylpyrophosphate) oxyacetate; Titanium dimethacrylate oxyacetate.

Preferably, Marklear AFL-23 or Markstat AL-14, polyethers available from Whitco Industries, are used as an antistatic agents.

The antistatic coating may be applied on the back surface of the support by, for example, spreading a solution comprising an antistatic agent (i.e., with a metering rod) onto the back surface of the support and then drying the support.

An example of one support of the present invention is Georgia Pacific brand Microprint Laser Paper. However, any non-woven cellulosic or film support may be used as the support in the present invention.

4. The Release Layer

The release layer is applied over the support or over the optional barrier layer. Any suitable release layer known in the art may be used as the release layer of the present invention. For instance, suitable release layers are disclosed in U.S. Pat. Nos. 4,021,591, 4,555,436, 4,657,557, 4,914,079, 4,927,709, 4,935,300, 5,322,833, 5,413,841, 5,679,461, and 5,741,387, all of which are herein incorporated by reference.

The release layer according to the present invention may have a solution viscosity of from 20 to 1500 cP, preferably 70–1000 cP, most preferably about 100–850 cP, as measured on a Brookfield DV-I+ viscometer, LV3 spindle at 60 rpm at a temperature of 30° C. Additionally, the release layer may be wet coated in an amount of from 50 g/m$^2$ to 150 g/m$^2$, preferably from 80–120 g/m$^2$, most preferably about 100 g/m$^2$. The surface tension of the release layer may be from 15–65 dynes/cm, preferably from 20–55 dynes/cm, most preferably about 45 dynes/cm as measured at room temperature.

The release layer of the present invention facilitates the transfer of the image layer from the support to the receptor. That is, the release layer of the present invention must provide the properties to effectively transfer the release layer, the image receiving layer and any images and/or optional layers thereon. Further, the release layer must also provide for adhesion of the release layer and the image area to the receptor without the requirement of a separate surface adhesive layer.

The release layer of the present invention may be prepared from, for example, a coating composition comprising an acrylic dispersion, an elastomeric emulsion, a plasticizer, and a water repellant.

The release layer of the present invention protects any transferred image, provides mechanical and thermal stability, as well as washability, preferably without losing the flexibility of the textile. That is, the release layer should also provide a colorfast image (e.g. washproof or wash resistant) when transferred to the receptor surface. Thus, upon washing the receptor element (e.g. tee shirt), the image should remain intact on the receptor.

According to-the present invention, the heat release layer may be a single layer or a plurality of heat release layers. Suitable materials for the heat release layer include polyvinylchloride plastisols which are dispersions of a vinyl resin in a non-aqueous liquid. Suitable plastisols, their preparation and application as heat release layers are described, for example, in U.S. Pat. No. 4,037,008. The heat release layer may also be a wax layer having a melting point lower than the barrier coating layer on the support sheet, if a barrier layer is present. Heat application to the transfer sheet melts the wax release layer allowing separation of the release layer from the backing sheet. Such wax release layers may be applied to the support sheet using an offset role as described in U.S. Pat. No. 4,322,467. The heat release layer described in U.S. Pat. No. 4,117,182 which contains an acrylic resin or cellulosic derivative, preferably in combination with a straight chain, primary aliphatic oxyalkylated alcohol, a plasticizer and a tackifier may also be used.

In one embodiment, the heat release layer is a two layer structure in which the first layer on top of said optional barrier layer or in contact with the support is a mixture of a vinyl resin and a polyethylene wax, and the second layer in contact with first layer is an ionomer polymer applied as a latex. The first layer is formed by heating the vinyl resin and wax and a solvent, such as toluene or a diluent such as odorless mineral spirits at a weight ratio of 70% solids to 30% solids, until the mixture is homogenous. When toluene is used, the mixture should be brought to a preferred temperature of from 82.2° C. to 96° C. in order to cause the resin to dissolve and liquefy. Suitable vinyl resins are copolymers of vinyl acetate and ethylene containing about 17–33% by weight vinyl acetate and having a melt index (as measured by ASTM D1238) of from 5 to 46.5. Suitable vinyl resins will have a resin density of about 0.933 to about 0.954 $gm/cm^3$ and a ring and ball softening point as measured by ASTM E28 of about 180° F. to 310° F. Suitable vinyl resins are commercially available as EVA 501 and EVA 505 from Union Carbide Corporation. The vinyl resin/wax mixture will generally contain 100–40 parts by weight vinyl resin and 20–80 parts wax.

Suitable polyethylene waxes are polyethylene waxes having a weight average molecular weight from about 1800 to 8000, a ring and ball softening point from about 100° C. to 120° C., a density from about 0.906–0.964 $gm/cm^3$ at 25° C. and a viscosity from about 230–1800 cp as measured by Brookfield Viscosity, No. 3 Spindle at 60 rpm. The polyethylene waxes may be either emulsifiable or non-emulsifiable. A suitable polyethylene wax is available as EPOLENE E14 from Eastman Chemical Products of Kingsport, Tenn.

The vinyl resin and polyethylene wax are blended together in heated solvent to form a hot clear solution which is uniformly applied over the support sheet using any conventional coating method such as an air knife, gravure roller or wire rod applicator. The first layer is preferably applied at about 3–10 lbs. per 1300 $ft^2$.

The second layer of ionomer polymer is applied over the first layer, preferably as a latex containing about 30% by weight polymer and 70% by weight water. Suitable ionomer dispersions are commercially available as 56220 SURLYN, 56230 SURLYN and 56256 SURLYN from E. I. DuPont. Ethylene-acrylic acid copolymers having an acrylic acid content of about 17–20% by weight and a melt index of from about 300 to 500 may also be used as the ionomer polymer. If it is desired to extrude the second layer onto the first layer, and ethylene-acrylic acid copolymer containing about 3–15% by weight acrylic acid and having a melt index of about 2–11 can be used. The second layer is preferably applied at a rate of about 1–4 lbs per 1300 ft This type of heat release layer is fully described in U.S. Pat. No. 4,235,657. A suitable support sheet having disposed thereon one or more heat release layers is commercially available as ULTIMA from Kimberly-Clark Company.

Further, the release layer of the present invention satisfies the requirement for compatible components, in that the component dispersions remain in their finely dispersed state after admixture, without coagulating or forming clumps or aggregated particles which would adversely affect image quality. Additionally, the release layer is preferably non-yellowing.

The above-described release layers all have a high content of organic solvent. However, release layers which have a low content of organic solvent are also embodied by the present invention. In connection with the present invention, release layers having a low organic solvent content are preferred.

Thus, in one embodiment of the present invention, the release layer has a low content of organic solvents, and any small amounts present during the coating process are sufficiently low as to meet environmental and health requirements. More specifically, the release layer preferably has a content of organic solvents of less than 2% weight by weight of components. More preferably, the release layer has a content of organic solvents of less than 1% weight by weight of components.

Particularly when the method for applying the image area of the image layer is a laser printer or copier, the release layer of the present invention preferably excludes wax dispersions derived from, for example, a group including but not limited to natural waxes such as carnauba wax, mineral waxes, montan wax, derivatives of montan wax, petroleum waxes, and synthetic waxes such as polyethylene and oxidized polyethylene waxes. If the imaging method used is a non-laser printer/copier method, waxes are not excluded from use in the transfer material. However, the amount of waxes that may be present in the transfer material of the invention when intended for use in laser printers or copiers must be sufficiently low as to avoid adverse affects on copier or printer operation. That is, the amount of wax present must not cause melting in the printer or copier.

The above properties make this release layer highly suited for making compatible the stringent requirements of the electrostatic imaging process with the requirements of heat transfer image technology to provide a product having good image quality and permanence under the demanding conditions of textile application, wear and wash resistance in use, and adhesion to wash resistance on decorated articles. The release layer is preferably a polymeric coating designed to provide a release from the support and adherence to a receptor when heat is applied to the back of the support.

Suitable examples of the release layers of the invention are exemplified below.

Thus, the nature of the film-forming binder is not known to be critical. That is, any film-forming binder can be employed so long as it meets the criteria specified herein. As a practical matter, water-dispersible ethylene-acrylic acid copolymers have been found to be especially effective film forming binders.

The term "melts" and variations thereof are used herein only in a qualitative sense and are not meant to refer to any particular test procedure. Reference herein to a melting temperature or range is meant only to indicate an approximate temperature or range at which a polymer or binder melts and flows under the conditions of a melt-transfer process to result in a substantially smooth film.

Manufacturers' published data regarding the melt behavior of polymers or binders correlate with the melting requirements described herein. It should be noted, however, that either a true melting point or a softening point may be given, depending on the nature of the material. For example, materials such as polyolefins and waxes, being composed mainly of linear polymeric molecules, generally melt over a relatively narrow temperature range since they are somewhat crystalline below the melting point.

Melting points, if not provided by the manufacturer, are readily determined by known methods such as differential scanning calorimetry. Many polymers, and especially copolymers, are amorphous because of branching in the polymer chains or the side-chain constituents. These materials begin to soften and flow more gradually as the temperature is increased. It is believed that the ring and ball softening point of such materials, as determined by ASTM E-28, is useful in predicting their behavior. Moreover, the melting points or softening points described are better indicators of performance than the chemical nature of the polymer or binder.

Representative binders (i.e., acrylic dispersions) for release from the support are as follows:

Binder A

Binder A is Michem® 58035, supplied by Michelman, Inc., Cincinnati, Ohio. This is a 35 percent solids dispersion of Allied Chemical's AC 580, which is approximately 10 percent acrylic acid and 90 percent ethylene. The polymer reportedly has a softening point of 102° C. and a Brookfield viscosity of 0.65 pas (650 centipoise) at 140° C.

Binder B

This binder is Michem® Prime 4983R (Michelman, Inc., Cincinnati, Ohio). The binder is a 25 percent solids dispersion of Primacor® 5983 made by Dow Chemical Company. The polymer contains 20 percent acrylic acid and 80 percent ethylene. The copolymer has a Vicat softening point of 43° C. and a ring and ball softening point of 100° C. The melt index of the copolymer is 500 g/10 minutes (determined in accordance with ASTM D-1238).

Binder C

Binder C is Michem® 4990 (Michelman, Inc., Cincinnati, Ohio). The material is 35 percent solids dispersion of Primacor® 5990 made by Dow Chemical Company. Primacor® 5990 is a copolymer of 20 percent acrylic acid and 80 percent ethylene. It is similar to Primacor® 5983 (see Binder B), except that the ring and ball softening point is 93° C. The copolymer has a melt index of 1,300 g/10 minutes and Vicat softening point of 39° C.

Binder D

This binder is Michem® 37140, a 40 percent solids dispersion of a Hoechst-Celanese high density polyethylene. The polymer is reported to have a melting point of 100° C.

Binder E

This binder is Michem® 32535 which is an emulsion of Allied Chemical Company's AC-325, a high density polyethylene. The melting point of the polymer is about 138° C. Michem® 32535 is supplied by Michelman, Inc., Cincinnati, Ohio.

Binder F

Binder F is Michem® 48040, an emulsion of an Eastman Chemical Company microcrystalline wax having a melting point of 88° C. The supplier is Michelman, Inc., Cincinnati, Ohio.

Binder G

Binder G is Michem® 73635M, an emulsion of an oxidized ethylene-based polymer. The melting point of the polymer is about 96° C. The hardness is about 4–6 Shore-D. The material is supplied by Michelman Inc., Cincinnati, Ohio.

In one embodiment of the invention, the release layer comprises an ethylene acrylic acid co-polymer dispersion, an elastomeric emulsion, a polyurethane dispersion, and polyethylene glycol.

The acrylic dispersion is present in a sufficient amount so as to provide adhesion of the release layer and image to the receptor element and is preferably present in an amount of from 46 to 90 weight %, more preferably 70 to 90 weight % based on the total composition of the release layer. Preferably, the acrylic dispersion is an ethylene acrylic acid co-polymer dispersion that is a film-forming binder that provides the "release" or "separation" from the substrate. The release layer of the invention may utilize the film-forming binders of the image-receptive melt-transfer film layer of U.S. Pat. No. 5,242,739, which is herein incorporated by reference.

The elastomeric emulsion provides the elastomeric properties such as mechanical stability, flexibility and stretchability, and is preferably present in an amount of from 1 to 45 weight %, more preferably 1 to 20 weight % based on the total composition of the release layer.

The plasticizer provides plasticity and antistatic properties to the transferred image, and is preferably present in an amount of from 1 to 8 weight %, more preferably 2 to 7 weight % based on the total composition of the release layer.

Another component of the release layer is an elastomeric emulsion, preferably a latex, and is compatible with the other components, and formulated to provide durability, mechanical stability, and a degree of softness and conformability to the layers.

Films of this material must have moisture resistance, low tack, durability, flexibility and softness, but with relative toughness and tensile strength. Further, the material should have inherent heat and light stability. The latex can be heat sensitized, and the elastomer can be self-crosslinking or used with compatible cross-linking agents, or both. The latex should be sprayable, or roll stable for continuous runnability on nip rollers.

Elastomeric latexes of the preferred type are produced from the materials and processes set forth in U.S. Pat. Nos. 4,956,434 and 5,143,971, which are herein incorporated by reference. This curable latex is derived from a major amount of acrylate monomers such as $C_4$ to $C_8$ alkyl acrylate, preferably n-butyl acrylate, up to about 20 parts per hundred of total monomers of a monolefinically unsaturated dicarboxylic acid, most preferably itaconic acid, a small amount of crosslinking agent, preferably N-methyl acrylamide, and optionally another monolefinic monomer.

Using a modified semibatch process in which preferably the itaconic acid is fully charged initially to the reactor with the remaining monomers added over time, a latex of unique polymer architecture or morphology is created, leading to the unique rubbery properties of the cured films produced therefrom.

Another component of the release layer is a water resistant aid such as a polyurethane dispersion which provides a self-crosslinking solvent and emulsifier-free aqueous dispersion of an aliphatic urethane-acrylic hybrid polymer which, alone, produces a clear, crack-free film on drying having very good scratch, abrasion and chemical resistance. This ingredient is also a softener for the acrylic dispersion and plasticizer aid.

Such product may be produced by polymerizing one or more acrylate and other ethylenic monomers in the presence of an oligourethane to prepare oligourethane acrylate copolymers. The oligourethane is preferably prepared from diols and diisocyanates, the aliphatic or alicyclic based diisocyanates being preferred, with lesser amounts, if any, of aromatic diisocyanates, to avoid components which contribute to yellowing. Polymerizable monomers, in addition to the usual acrylate and methacrylate esters of aliphatic monoalcohols and styrene, further include monomers with carboxyl groups, such as acrylic acid or methacrylic acid, and those with other hydrophilic groups such as the hydroxyalkyl acrylates (hydroxyethyl methacrylate being exemplary). The hydrophilic groups in these monomers render the copolymer product dispersible in water with the aid of a neutralizing agent for the carboxyl groups, such as dimethylethanolamine, used in amount to at least partially neutralize the carboxyl groups after dispersion in water and vacuum distillation to remove any solvents used to prepare the urethane acrylic hybrid.

Further formulations may include the addition of crosslinking components such as amino resins or blocked polyisocyanates. Although pigments and fillers could be added to any of the coating layers, such use to uniformly tint or color the coated paper could be used for special effect, but would not be used where an image is desired in the absence of background coloration. Urethane acrylic hybrid polymers are further described in U.S. Pat. No. 5,708,072, and their description in this application is incorporated by reference.

Self crosslinking acrylic polyurethane hybrid compositions can also be prepared by the processes and materials of U.S. Pat. No. 5,691,425, herein incorporated by reference. These are prepared by producing polyurethane macromonomers containing acid groups and lateral vinyl groups, optionally terminal vinyl groups, and hydroxyl, urethane, thiourethane and/or urea groups. Polymerization of these macromonomers produces acrylic polyurethane hybrids which can be dispersed in water and combined with crosslinking agents for solvent-free coating compositions.

Autocrosslinkable polyurethane-vinyl polymers are discussed in detail in U.S. Pat. Nos. 5,623,016 and 5,571,861, and their disclosure of these materials is incorporated by reference. The products usually are polyurethane-acrylic hybrids, but with self-crosslinking functions. These may be carboxylic acid containing, neutralized with, e.g. tertiary amines such as ethanolamine, and form useful adhesives and coatings from aqueous dispersion.

The elastomeric emulsion and polyurethane dispersion are, generally, thermoplastic elastomers. Thermoplastic elastomeric polymers are polymer blends and alloys which have both the properties of thermoplastic polymers, such as having melt flow and flow characteristics, and elastomers, which are typically polymers which cannot melt and flow due to covalent chemical crosslinking (vulcanization). Thermoplastic elastomers are generally synthesized using two or more monomers that are incompatible; for example, styrene and butadiene. By building long runs of polybutadiene with intermittent polystyrene runs, microdomains are established which imparts the elastomeric quality to the polymer system. However, since the microdomains are established through physical crosslinking mechanisms, they can be broken by application of added energy, such as heat from a hand iron, and caused to melt and flow; and therefore, are elastomers with thermoplastic quality.

Thermoplastic elastomers have been incorporated into the present invention in order to provide the image transfer system with elastomeric quality. Two thermoplastic elastomer systems have been introduced; that is, a polyacrylate terpolymer elastomer (for example, Hystretch V-29) and an aliphatic urethane acryl hybrid (for example, Daotan VTW 1265). Thermoplastic elastomers can be chosen from a group that includes, for example, ether-ester, olefinic, polyether, polyester and styrenic thermoplastic polymer systems. Specific examples include, by way of illustration, thermoplastic elastomers such as polybutadiene, polybutadiene derivatives, polyurethane, polyurethane derivatives, styrene-butadiene, styrene-butadiene-styrene, acrylonitrile-butadiene, acrylonitrile-butadiene-styrene, acrylonitrile-ethylene-styrene, polyacrylates, polychloroprene, ethylene-vinyl acetate and poly (vinyl chloride). Generally, thermoplastic elastomers can be selected from a group having a glass transition temperature (Tg) ranging from about −50° C. to about 25° C.

Another component of the release layer is a plasticizer such as a polyethylene glycol dispersion which provides mechanical stability, water repellency, and allows for a uniform, crack-free film. Accordingly, a reason to add the polyethylene glycol dispersion is an aid in the coating process. Further, the polyethylene glycol dispersion acts as an softening agent. A preferred fourth component is Carbowax Polyethylene Glycol 400, available from Union Carbide.

Another optional ingredient of the release layer is a surfactant and wetting agent such as polyethylene glycol mono ((tetramethylbutyl) phenol) ether.

In another embodiment of the invention, the release layer comprises an acrylic binder and a wax emulsion. The release layer may further contain a retention aid such as Hercobond 2000®. The retention aid provides water resistance, which enhances the washability of the image on the receptor.

Various additives may be incorporated into the release layer or the barrier and/or image areas. Retention aids, wetting agents, plasticizers and water repellants are examples. Each will be discussed in turn, below.

An additive may be incorporated for the purpose of aiding in the binding of the applied colorant such as water-based ink jet colorants and/or dry or liquid toner formulations. Such additives are generally referred to as retention aids. Retention aids may be added in amounts of 0.5–90%, preferably 1–50%, most preferably 1–20% by weight. Retention aids that have been found to bind colorants generally fall into three classes: silicas, latex polymer and polymer retention aids. Silicas and silicates are employed when the colorant is water-based such as ink jet formulations. An example of widely used silicas are the Ludox (DuPont) brands. Polyvinyl alcohol represents as class of polymers that have also been applied to the binding of ink jet dyes. Other polymers used include anionic polymers such as Hercobond 2000 (Hercules). Reten 204LS (Hercules) and Kymene 736 (Hercules) are cationic amine polymer-epichlorohydrin adducts used as retention aids. In addition, polyquaternium polymers, epi-amines, amides, polyamides, cationically modified starches and celluloses, and various other cationic polymers can be readily used as retention aids. Latex polymers include, by way of illustration, vinyl polymers and vinyl co-polymer blends such as ethylene-vinyl acetate, styrene-butadiene copolymers, polyacrylate and other polyacrylate-vinyl copolymer blends.

Wetting agents, rheology modifiers and surfactants may also be included in the release layer in amounts of 0.05–90%, preferably 1–50%, most preferably 1–20% by weight. Such agents may either be nonionic, cationic or anionic. The surfactant selected should be compatible with the class of polymers used in a formulation. For example, anionic polymers require the use of anionic or non-ionic wetting agents or surfactants. Likewise, cationic surfactants are stable in polymer solution containing cationic or non-ionic polymers. Examples of surfactants or wetting agents include, by way of illustration, alkylammonium salts of polycarboxylic acid, salts of unsaturated polyamine amides, derivatives of nonoxynol, derivatives of octoxynols (Triton X-100 and Triton X-114 (Union Carbide), for example), dimethicone copolymers, silicone glycol copolymers, polysiloxane-polyether copolymers, alkyl polyoxy carboxylates, tall oil fatting acids, ethylene oxide-propylene oxide block copolymers and derivatives of polyethylene glycol.

Viscosity modifiers may also be included in amounts such as 0.5–90%, preferably 1–50%, most preferably 1–20% by weight. Generally, various molecular weight polyethylene glycols are incorporated to serve this purpose. Polyethylene glycols used generally range in molecular weight from 100 to 500,000 with molecular weights between 200 and 1000 being the most useful in this application.

Plasticizers may be included in order to soften hard polymer and polymer blend additions. Plasticizers may be added in amounts of 0.5–90%, preferably 1–50%, most preferably 1–20% by weight. Plasticizers used include, by way of illustration, aromatic derivatives such as di-octyl phthalate, di-decyl phthalate derivatives and tri-2-ethylhexyl trimellitate. Aliphatic plasticizers include derivatives of ethylhexyl adipates and ethylhexyl sebacates. Epoxidized linseed or soya oils may also be incorporated but generally are not used due to yellowing and chemical instability upon heat application.

Water repellant aids may also be incorporated into order to improve the wash/wear resistance of the transferred image. Water repellant aids may be added in amounts of 0.5–90%, preferably 1–50%, most preferably 1–20% by weight. Examples of additives include polyurethanes, wax dispersions such as carnauba wax, mineral waxes, montan wax, derivatives of montan wax, petroleum waxes, synthetic waxes such as polyethylene and oxidized polyethylene waxes, hydrocarbon resins, amorphous fluoropolymers and polysiloxane derivatives.

Suitable release layers also include those disclosed in U.S. application Ser. No. 09/541,083 filed Mar. 31, 2000 and Ser. No. 09/557,173 filed Apr. 21, 2000, which are herein incorporated by reference.

In another embodiment the release layer of the present invention may contain (1) PCC, (2) PVP, or (3) both PCC and PVP (PCC/PVP) as additional constituent(s). The PCC or PVP or PCC/PVP which may be incorporated into the release layer are the same as described below with respect to the image receiving layers. It is to be noted that this blended release layer is still overcoated with one of the image receiving layers discussed below.

The release layer of the present invention may also contain salts which act as dye retention aids and drying additives. In this embodiment, Alkali earth (Group IIA), Group 3A and transition metal salts of halide or complex polyanions can be used as colorant retention and/or drying aids. Primarily, magnesium, calcium, aluminium, and zinc salts are selected since these counterions are known to complex with water-based colorants via electrostatic interactions. Metal colorant complexes of the said counterions are generally insoluble in water, once formed; and therefore, provide waterfast properties to an image comprising these complexed dyes. In addition, nano- or microcrystals of these metal salts would impart a drying property via a water hydration or absorption mechanism.

The image receiving layer of the present invention discussed below may also be formulated to contain these metal salts. By way of illustration, the following reactions may be performed within the Release Layer and/or Image Receiving Layer. General chemical formulas will be illustrated without notation as to the degree of water hydration.

Reaction Scheme 1

| Reagent A | + | Reagent B | = | Product |
|---|---|---|---|---|
| $Ca_3$ (Citrate) | | $Na_2CO_3$ | | $CaCO_3$ |
| Ca (Acetate)$_2$ | | $K_2CO_3$ | | $MgCO_3$ |
| $Mg_3$ (Citrate) | | $Na_x$ (Polyanion B)$_y$ | | $Al_2$ $(CO_3)_3$ |
| $Mg_3$ (Acetate) | | $K_x$ (Polyanion B)$_y$ | | $Ca_x$ (Polyanion B)$_y$ |
| $Ca_x$ (Polyanion A)$_y$ | | | | $Mg_x$ (Polyanion B)$_y$ |
| $Mg_x$ (Polyanion A)$_y$ | | | | $Al_x$ (Polyanion B)$_y$ |
| $Al_x$ (Polyanion A)$_y$ | | | | |

Reaction Scheme 2

| Reagent A | + | Reagent B | = | Product |
|---|---|---|---|---|
| Zn (Acetate)$_2$ | | $Na_2CO_3$ | | $ZnCO_3$ |
| $Zn_3$ (Citrate) | | $K_2CO_3$ | | $Zn_x$ (Polyanion B)$_y$ |
| $ZnCl_2$ | | $Na_x$ (Polyanion B)$_y$ | | |
| $Zn_x$ (Polyanion)$_y$ | | $K_x$ (Polyanion B)$_y$ | | |

The reaction schemes are read such that any Reagent A can react with any Carbonate salt to form the corresponding salt precipitate. Also, any Reagent A can react with any salt of a polyanion (Polyanion B) to form the corresponding insoluble salt precipitate. Polyanion B may be, by way of example, a carbonate, bicarbonate, phosphate, sulfate, bisulfate or any sugar or amino acid polyanionic counterion. Polyanion B may also be replaced by a halide anion such as Chloride or Bromide.

The reaction is performed under conditions that promote the formation of nano- or microcrystals, within the film layer formulation, prior to coating. For example, Calcium Acetate is reacted with Sodium Carbonate under both a rapid stirring and reagent injection rate. The two reactants can be injected together, under conditions of rapid stirring, in what is known as a double jet addition; or, one of the reagents may already be present in the film layer formulation; and then, the second component is rapidly injected under a protocol known as a single jet addition.

Under rapid stirring, the microcrystals formed would be evenly dispersed within the film layer formulation. The reagent concentrations can be adjusted to produce a final film layer formulation that contains between about 1 to about 95% precipitated salt. The Reagent B can be in molar excess relative to Reagent A. Alternatively, balanced molar relationships may be formulated between Reagents A and B.

5. The Image Receiving Layer

An image receiving layer is applied over the heat release layer. There are three main types of image receiving layers according to the present invention. These are 1) a PCC-containing image receiving layer, 2) a PVP-containing image receiving layer, and 3) a PCC/PVP image receiving layer.

1. The PCC-Containing Image Receiving Layer

The PCC-containing image receiving layer of the present invention comprises PCC, and optionally, a binder. Additive may also be optionally added.

PCC suitable for use may be purchased from any distributor. PCC is conventionally produced by bubbling a gas containing carbon dioxide through an aqueous suspension of calcium hydroxide. Other inorganic materials, in particular, inorganic materials containing aluminum, such as alum, can be coprecipitated with PCC, or can be precipitated onto the surface of the PCC precipitate. Additionally, the PCC may be heat aged and/or milled.

The PCC component of the PCC-containing image receiving layer is incorporated in an amount of from 20–100% by weight based on the total weight of the PCC-containing image receiving layer. If the amount of PCC used is below 20%, the PCC-containing image receiving layer is insufficient to cover the underlying layers and consequently, an image cannot be properly applied. Preferably, the PCC component of the PCC-containing image receiving layer is incorporated in an amount of from 50–95%, by weight based on the total weight of the PCC-containing image receiving layer. Most preferably, the PCC component of the PCC-containing image receiving layer is incorporated in an amount of from 75–95%, by weight based on the total weight of the PCC-containing image receiving layer. These % by weight amounts are calculated based on a PCC slurry containing 25% solids.

Binders suitable for use in the PCC-containing image receiving layer are the same as the binders which may be used in the release layer or the optional barrier layer of the present invention, both of which are discussed above.

Examples of binders also include, but are not limited to, polyvinyl alcohol ("PVOH") and derivatives thereof, oxidized starch, etherified starch, esterified starch, dextrin and like starches, carboxymethylcellulose, hydroxyethylcellulose and like cellulose derivatives, casein, gelatin, soybean protein, amides, polyamides, and quaternized fatty amides, maleic anhydride resin, lattices of usual styrene butadiene copolymer, methyl methacrylate-butadiene copolymer and like conjugated diene polymers or copolymers, and lattices of acrylate and methacrylate polymers or copolymers and like acrylic polymers, and latex.

Specific examples of binders to be utilized in the PCC-containing image receiving layer include; Freepel FX-1202™, by BF Goodrich, an emulsion of wax, melamine and fluorochemical polymer; ethylene acrylic acid copolymer dispersion, Michem Prime 4983R, by Michelman; an elastomeric latex emulsion, and PVOH, Airvol 107 by Air Products.

The binder component of the PCC-containing image receiving layer is incorporated in an amount of from 0–80%, preferably 5–40% by weight based on the total weight of the PCC-containing image receiving layer. Most preferably, the binder component of the PCC-containing image receiving layer is incorporated in an amount of from 5–25% by weight based on the total weight of the PCC-containing image receiving layer.

When required, the PCC-containing image receiving layer may have further incorporated therein additives in amounts conventionally used in the art, including but not limited to softeners, surfactants, humectants, conventional pigment dispersants, tackifiers, UV absorbers, mold inhibitors, antioxidants, optical brighteners, flowability modifiers, defoaming agents, foaming inhibitors, release agents, microporous and mesoporous molecular sieves, coloring agents, and dye binding additive as are known to those skilled in the art and as previously discussed herein.

An example of a cationic dye binding additive used in the present invention is OSC-470™, by Ontario Specialty Coatings.

The additives which are optionally added to the PCC-containing image receiving layer are added in small amounts of less than 25% by weight for all additives, based on the total weight of the PCC-containing image receiving layer.

The PCC-containing image receiving layer may be coated by any standard coating technique, for example, metered rod draw down, gravure, etc. Additionally, one or multiple PCC-containing image receiving layer may be applied.

The PCC-containing image receiving layer is coated with a dry weight of 1–40 g/m$^2$, preferably 1–20 g/m$^2$, most preferably 1–10 g/m$^2$. In practice, the PCC-containing image receiving layer is applied by a single pass with a No. 4 metered rod. Based on this single pass, the dry coat weight is 2.5–3 g/m$^2$.

The PCC-containing image receiving layer is applied with a dry coat thickness of 0.01–15 mils, preferably 0.01 to 2 mils, most preferably about 0.1 mils to about 1.5 mils.

After application, the PCC-containing image receiving layer may be dried by any conventional drying technique, for example, air dry, forced air, element heating, etc.

2. The PVP-Containing Image Receiving Layer

The PVP-containing image receiving layer of the present invention comprises PVP and optionally a binder. Additive may also optionally be added.

Crosslinked and non-crosslinked PVPs are suitable for use in the present invention. Copolymers of the crosslinked or non-crosslinked PVP are also suitable for use in the present invention, including but not limited to copolymers of PVP and polyvinylimidazoles, vinylimidazoles, vinyl acetates, polyvinyl acetates, vinyl acrylates, styrenes, polystyrenes, polyesters, polyolefins and polyamides.

The PVP component of the PVP-containing image receiving layer is incorporated in an amount of from 20–100% by weight based on the total weight of the image receiving layer. Preferably, the PVP component of the PVP-containing image receiving layer is incorporated in an amount of from 40–90%, by weight based on the total weight of the image receiving layer. Most preferably, the PVP component of the PVP-containing image receiving layer is incorporated in an amount of from 75–95%, by weight based on the total weight of the image receiving layer.

Binders suitable for use in the PVP-containing image receiving layer are the same as the binders which may be used in the PCC-containing image receiving layer, the release layer and the optional barrier layer of the present invention, all of which are discussed above.

The binder component of the PVP-containing image receiving layer is incorporated in an amount of from 0–80%, preferably 0.1–60% by weight based on the total weight of the image receiving layer. Most preferably, the binder component of the PVP-containing image receiving layer is incorporated in an amount of from 0.1–30% by weight based on the total weight of the image receiving layer.

When required, the PVP-containing image receiving layer may have further incorporated therein additives in amounts conventionally used in the art, including but not limited to softeners, surfactants, humectants, conventional pigment dispersants, tackifiers, UV absorbers, mold inhibitors, antioxidants, optical brighteners, flowability modifiers, defoaming agents, foaming inhibitors, release agents, microporous and mesoporous molecular sieves, coloring agents, and dye binding additive as are known to those skilled in the art and as previously discussed herein. These are the same additives referred to above with respect to the PCC-containing image receiving layer.

The additives which are optionally added to the PVP-containing image receiving layer are added in small amounts of less 40% by weight, preferably less than 25% by weight for all additives, based on the total weight of the image receiving layer.

The PVP-containing image receiving layer may be coated by any standard coating technique, for example, metered rod draw down, gravure, etc. Additionally, one or multiple PVP-containing image receiving layer may be applied.

The PVP-containing image receiving layer is coated with a dry weight of 1–100 g/m$^2$, preferably 2–50 g/m$^2$, most preferably 2–30 g/m$^2$.

The PVP-containing image receiving layer is applied with a thickness of 0.05–2.00 mils, preferably 0.1 to 2.0 mils, most preferably 0.1–1.0 mils.

After application, the PVP-containing image receiving layer may be dried by any conventional drying technique, for example, air dry, forced air, element heating, etc.

3. The PCC/PVP-Containing Image Receiving Layer

The PCC/PVP-containing image receiving layer of the present invention comprises PCC, PVP and optionally a binder. Additive may also optionally be added.

Suitable PCC and PVP are the same as the PCC and PVP which are described above.

The PCC component of the PCC/PVP-containing image receiving layer is incorporated in an amount of from 0.1–95%, preferably 5–85%, more preferably 30–70% by w based on the total weight of the image receiving layer.

The PVP component of the PCC/PVP-containing image receiving layer is incorporated in an amount of from 5–99.9%, preferably 10–95%, more preferably 20–85% by weight based on the total weight of the image receiving layer.

Binders suitable for use in the PVP-containing image receiving layer are the same as the binders which may be used in the PCC-containing image receiving layer, the release layer and the optional barrier layer of the present invention, all of which are discussed above.

The binder component of the PCC/PVP-containing image receiving layer is incorporated in an amount of from 0–80%, preferably 1–80%, more preferably 5–40%, most preferably 5–25% by weight based on the total weight of the image receiving layer.

When required, the PCC/PVP-containing image receiving layer may have further incorporated therein additives in amounts conventionally used in the art, such as softeners, surfactants, humectants, conventional pigment dispersants, tackifiers, UV absorbers, mold inhibitors, antioxidants, optical brighteners, flowability modifiers, defoaming agents, foaming inhibitors, release agents, microporous and mesoporous molecular sieves, coloring agents, and dye binding additive as are known to those skilled in the art and as previously discussed herein. These are the same additives referred to above with respect to the PCC-containing image receiving layer.

The additives which are optionally added to the PCC/PVP-containing image receiving layer are added in small amounts of less than 25% by weight for all additives, based on the total weight of the image receiving layer.

The image-receiving layer may further comprise an additive capable of emitting radiation within the visible light spectrum. For example, this additive may be an organic, inorganic and/or organometallic compound that has a quantum yield for fluorescence in the range of from 0.001 to 1.0. Alternatively, the additive may be an organic, inorganic and/or an organometallic compound that has a quantum yield for phosphorescence in the range of from 0.001 to 1.0. These additive systems may have radiative lifetimes of at least one nanosecond.

Examples of a suitable inorganic compound include those derived from lanthamide, alkali earth or transition metals which are reacted with elements of groups four, five or six of the Periodic Table. Additional examples of suitable inorganic compounds include those derived from members of the alkali earth or transition metals which are reacted with sulfur, thereby producing a luminescent sulfide complex. Examples of luminescent sulfide complexes include luminescent pigments such as zinc sulfide, copper sulfide, strontium sulfide or combinations thereof.

Examples of a suitable organic compound include aromatic and polycyclic aromatic compounds, such as coumarin, rhodamine and their derivatives, as well as 2,5-diphenyloxazole and 1,4-Bis(5-phenyloxazol-2-yl)benzene.

The additives capable of emitting radiation within the visible light spectrum may be present at concentrations in the range of from 0.05% to 80%, preferably 0.05% to 20%, and most preferably 0.05% to 10% by dry weight.

The PCC/PVP-containing image receiving layer may be coated by any standard coating technique, for example, metered rod draw down, gravure, etc. Additionally, one or multiple PVP-containing image receiving layer may be applied.

The PCC/PVP-containing image receiving layer is coated with a dry weight of 1–100 g/m$^2$, preferably 2–50 g/m$^2$, most preferably 2–30 g/m$^2$.

The PCC/PVP-containing image receiving layer is applied with a thickness of 0.05–2.00 mils, preferably 0.1 to 2.0 mils, most preferably 0.2–1.5 mils.

After application, the PCC/PVP-containing image receiving layer may be dried by any conventional drying technique, for example, air dry, forced air, element heating, etc.

6. The Optional Image Layer

An image layer containing image and non-image area(s) is optionally applied over the image receiving layer. The image layer may be applied by a conventional printing process, including application of halftone and color separations to the heat release layer by lithographic offset printing or other standard surface-to-surface printing processes. The halftone or full color processes may utilize standard air-drying process inks or latex-based air-drying inks. Printing may be conducted as a positive or negative image.

Suitable images can be obtained on the image layer using standard lithographic inks. The inks should be selected so that the inks are compatible with the later heat treatment which is necessary to transfer the image to the receptor element. Heat resistant inks are, therefore, preferred. Drying speed can be improved by modifying the ink compositions to use a low quantity of drying oils and/or fast drying oils. The inks should also be selected such that the inks of the color separations are compatible with each other and with subsequent heat processing in order to produce an accurate sharp ink design.

Suitable inks having the properties identified above can be prepared by combining conventional red (rhodamine), yellow (benzedrine), blue (cyan) and black (process black) inks with an ink vehicle containing suitable resins and drying oils. A preferred ink vehicle contains 5–20 wt. %, preferably 7–13 wt. % of a drying (oxidizing) oil alkyd resin having an acid number of 2–25, preferably 5–20 and a Gardener Holdt viscosity of Z4 to Z6 at 25° C. The alkyd resin is preferably prepared using a sufficient amount of drying oil such that the oil length of the alkyd can be classified as a long oil alkyd of 50–90 wt. %, preferably 65–80 wt. % oil content.

Alternatively, dye combinations can be used wherein the dyes participate in radiation transfer either radiatively or non-radiatively (e.g. electron transfer). In radiation transfer, one dye of the combination of dyes receives radiation and transfer the energy to another dye in the combination. Thus, the dye combination contains a donor dye, which transfers energy, and an acceptor dye, which accepts the energy from the donor dye and re-emits the energy, or a portion thereof, as electromagnetic energy in the visible spectrum. Typically, the energy level at which the acceptor dye re-emits the energy is at a lower level than that emitted by the donor dye.

The dyes to be used in the dye combination include organic, inorganic and/or organometallic compounds that have a quantum yield for fluorescence in the range of from 0.001 to 1.0. Alternatively, the dye may be organic, inorganic and/or an organometallic compounds that have a quantum yield for phosphorescence in the range of from 0.001 to 1.0. These dye systems may have radiative lifetimes of at least one nanosecond.

Examples of a suitable inorganic compound include those derived from lanthamide, alkali earth or transition metals which are reacted with elements of groups four, five or six of the Periodic Table. Additional examples of suitable inorganic compounds include those derived from members of the alkali earth or transition metals which are reacted with sulfur, thereby producing a luminescent sulfide complex. Examples of luminescent sulfide complexes include luminescent pigments such as zinc sulfide, copper sulfide, strontium sulfide or combinations thereof.

Examples of a suitable organic compound include aromatic and polycyclic aromatic compounds, such as coumarin, rhodamine, fluorescein and their derivatives, as well as 2,5-diphenyloxazole and 1,4-Bis(5-phenyloxazol-2-yl)benzene. Fluorescein derivatives and isomers may be the sodium salt forms, fluoresceinamine, diacetate and isothiocyanate. Coumarin isomers and derivatives include Coumarin-1, Coumarin-4, Coumarin-6, Coumarin-7, Coumarin-120, Coumarin-152, Coumarin-314, Coumarin-334, Coumarin-337, Coumarin-343 and carboxylated isomer derivatives. Rhodamine isomers and derivatives include rhodamine-123, rhodamine-B, rhodamine-B isocyanate, rhodamine-6G, rhodamine-6G perchlorate, rhodamine-6G tetrafluoroborate and rhodamine-110. The lactone derivatives of each of these may also be used.

Other systems include azo dyes such as CI Direct Yellow 86, CI Acid Red 249 and CI Direct Blue 199. Member dyes from the meracyanine, carbocyanine, indolene, imidazole, thiozole and oxazole class of compounds may also be selected. Organometallic systems may include metal containing substituted hemes, such as phthalocyanine complexed with members of the transition groups 6B, 8B, 1B and 2B. Porphyrin systems, such as Mesoporphyrin IX, complexed with the same transition element groups may also be selected. The dyes may be present at concentrations in the range of from 0.05% to 80%, preferably 0.05% to 20%, and most preferably 0.05% to 10% by dry weight.

The preferred ink vehicle also contains one or more esters of a modified rosin or polymerized rosin acid in an amount of about 5–30 wt. %, preferably 10–25 wt. %. These esters will generally have a melting point of about 120° C. to 220° C., preferably 140° C. to 190° C. and an acid number of 5–35, preferably 8–25. In a particularly preferred embodiment, two pentaerythritol esters of modified rosin and polymerized rosin acids are used, 5–10 wt % of a first ester having a melting point of 140° C. to 155° C. and an acid number of 8–25, and 5–15 wt. % of a second ester having a melting point of 175° C. to 190° C. and an acid number of 8–17.

Finally, the ink vehicle contains one or more drying oils in an amount of 2–15 wt. %, preferably 4–8 wt. %. Suitable drying oils include linseed oil, tung oil, etc., and mixtures thereof. Ink oils, preferably high boiling petroleum hydrocarbon fractions, are preferred solvents for the ink vehicle. Such ink oils are well known and generally have a boiling point range from about 200.degree.–300.degree. C., preferably 225.degree.–275.degree. C. and a K.B. value of 20–35, preferably 24–30. The ink oils and drying oils solubilize the alkyd resin enabling smooth application of the ink-containing vehicle with conventional lithographic offset printing equipment.

The image layer may be formed through the use of conventional laser printers, ink jet printers, bubblejet printers, thermal inkjet methods, piezo inkjet methods, and the like.

7. The Optional Non-Water-Dispersible Polymer Layer

A polymer layer containing a non-water-dispersible polymer is optionally coated over the image layer. The non-water-dispersible polymer layer may be applied by any suitable coating process. Conveniently, the non-water-dispersible polymer layer is applied from a conventional coating tower suitable for use with lithographic offset printing equipment. The polymer coat formed by this process may be air-dried or, preferably is dried using a conventional infrared dryer.

The non-water-dispersible polymer layer is for example, a plastisol. Generally, a plastisol is a dispersion of polyvinylchloride (PVC) particles in liquid organic media. Plastisols are prepared using high boiling liquids which are absorbed by and plasticize the particles, and remain in the final product. Accordingly, the plastisols suitable for use in the non-water-dispersible polymer layer of the present invention are preferably plastisols which fall into the vinyl polymer class. For example, vinyl chloride polymers and copolymers. These vinyl polymers are generally polyvinyl chloride (PVC) polymer formulations. These PVC polymer formulations contain, in combination with PVC, for example, phthalate esters, inert fillers and/or organic/inorganic pigments. Specifically suitable examples include, but are not limited to, TransFlex Series, XL Flash 360 White (also known as Phantom White), and Bright Tiger White, all by Wilflex. These Wilflex products are composed of PVC, phthalate esters, inert fillers, and optionally organic/inorganic pigments.

The non-water-dispersible polymer layer of the present invention can also be applied as a clear coat base. For example, a clear plastisol base such as Soft Hand Clear #10140, by Wilflex. This clear plastisol base may also be combined with pigmented inks to form a colored non-water-dispersible polymer layer.

If viscosity modification is desired, reducers may be added. For example, if viscosity reduction is desired, up to 5 wt. % of a reducer, such as Wilflex Curable Reducer #10070, may be added.

The polymers are commercially available for coating graphic arts paper or paper board with an in-line coater. The polymer dispersion is applied at a rate of 0.5–6.0, preferably 1.5–5.0 lbs per 1300 $ft^2$. The non-water-dispersible polymer layer is preferably applied using a 350 to 65 mesh. Dry coat weights range from about 10 to about 100 $g/m^2$, preferably about 50 $g/m^2$.

In another embodiment of the present invention, the non-water-dispersible polymer layer is applied over the image areas of the image layer only and the transfer blocking overcoat layer is applied over the non-image areas of the image layer only.

The non-water-dispersible polymer layer may further comprise an additive capable of emitting radiation within the visible light spectrum. For example, this additive may be an organic, inorganic and/or organometallic compound that has a quantum yield for fluorescence in the range of from 0.001 to 1.0. Alternatively, the additive may be an organic, inorganic and/or an organometallic compound that has a quantum yield for phosphorescence in the range of from 0.001 to 1.0. These additive systems may have radiative lifetimes of at least one nanosecond.

Examples of a suitable inorganic compound include those derived from lanthamide, alkali earth or transition metals which are reacted with elements of groups four, five or six of the Periodic Table. Additional examples of suitable inorganic compounds include those derived from members of the alkali earth or transition metals which are reacted with sulfur, thereby producing a luminescent sulfide complex. Examples of luminescent sulfide complexes include luminescent pigments such as zinc sulfide, copper sulfide, strontium sulfide or combinations thereof.

Examples of a suitable organic compound include aromatic and polycyclic aromatic compounds, such as coumarin, rhodamine and their derivatives, as well as 2,5-diphenyloxazole and 1,4-Bis(5-phenyloxazol-2-yl)benzene.

The additives capable of emitting radiation within the visible light spectrum may be present at concentrations in the range of from 0.05% to 80%, preferably 0.05% to 20%, and most preferably 0.05% to 10% by dry weight.

8. The Optional Transfer Blocking Overcoat Layer

A transfer blocking overcoat layer is optionally applied over the image layer or over the optional non-water-dispersible polymer layer of the present invention. Alternatively, as discussed above, a transfer blocking overcoat layer may be applied over the non-image areas of the image layer only and the optional non-water-dispersible polymer layer may be applied over the image areas of the image layer only.

The transfer blocking overcoat layer may be applied using a conventional printing process, preferably a conventional screen printing process. The transfer blocking overcoat layer is printed over the optional non-water-dispersible polymer layer or the non-image areas of the image layer, such that the transfer blocking overcoat layer outlines one or more of the image areas present in the image layer. That is, the transfer blocking overcoat layer outlines at least one imaged area or selected imaged areas and thereby circumferentially defines the outer boundary of each imaged area which will be transferred during the heat transfer process. By "selected imaged areas" the present invention is referring to an image area which is less than the entire image area present in the image layer. In other words, if an imaged area is to be outlined by the transfer blocking overcoat layer, if desired, only a portion (or "selected imaged areas") need be outlined. Thus, a plurality of imaged areas may be present in a single image layer, where the transfer blocking overcoat layer simultaneously defines the boundary of each imaged area or selected imaged areas. Preferably, the transfer blocking overcoat layer is applied to the optional polymer layer or the image layer so that the transfer blocking overcoat layer covers the entire transfer sheet except the portion of the transfer sheet within the outline circumscribing the image area or areas which will be transferred. The transfer blocking overcoat layer does not cover the image area within the outline, that is, the transfer blocking overcoat layer is not present on the optional polymer layer or the image layer within the outline of the image area. It is noted that the phrase "selected image area" applies to the application of both the non-water-dispersible polymer layer and the transfer blocking overcoat layer.

The transfer blocking overcoat layer may additionally be coated such that it overlaps the outer perimeter of the image area to a small degree, for example, about one eighth of an inch.

To apply the transfer blocking overcoat layer several conventional techniques including but not limited to flexo, gravure, lithographic techniques and metering rod coating. First, the artisan must determine what portions of the image areas which are desired to have a defined edge free from a polymer halo. Once this is established, the transfer blocking overcoat layer is applied, by one of the above methods to the boundary of that selected image area.

Application of sufficient heat (e.g., through the support) transfers the optional non-water dispersible polymer layer, image layer, image receiving layer, and heat release layer within the outline of the transfer blocking overcoat, onto and/or into the receptor element.

The transfer blocking overcoat layer is, preferably, a thermosetting lacquer composition which fuses with the underlying optional polymer layer, image layer, image receiving layer, heat transfer layer, and optional barrier layer when heat is applied to the transfer sheet, thereby preventing transfer of any portion of the transfer sheet which is covered by the transfer blocking overcoat layer. The transfer blocking overcoat layer is non-adhesive to the receptor and prevents formation of a polymer halo on the receptor element.

The transfer blocking overcoat layer can be formed from a conventional industrial screen ink lacquer. The composition of the industrial lacquer may be varied widely and is not particularly limited so long as the lacquer is non-adhesive to the receptor and bonds to the underlying optional polymer layer or image layer, preventing heat transfer of the underlying layer. The industrial lacquer is preferably a polymeric, crosslinked resin material which may, optionally, contain a solid filler or pigment. Suitable crosslinked polymeric materials include epoxy-polyesters, epoxy-polyamides, polyisocyanate/polyester mixtures, polyisocyanate/polyol mixtures, urethane/acrylic mixtures. The transfer blocking overcoat may be opaque or transparent, or may contain a pigment or filler to impart a desired color. Preferably, the transfer blocking overcoat is clear or opaque to avoid any possibility of color transfer to the receptor element during the heat transfer process.

The industrial lacquer used to form the transfer blocking overcoat layer may contain two or more crosslinkable polymeric components which react together to form the crosslinked transfer blocking overcoat layer. For example, a first component such as polymethyl polyphenylisocyanates, aromatic and aliphatic polyisocyanate prepolymers, toluene diisocyanate based adducts, copolymers of aromatic and aliphatic polyisocyanates, toluene polyisocyanurate, polyfunctional aliphatic isocyanates, blocked isocyanate prepolymers, 2,4-toluene diisocyanates, prepolymers of diphenyl methane L0 diisocyanates, epoxy and oxirane resins may be combined with a second component such as hydroxyl terminated castor oils, hydroxyl terminated linear and branched polyesters, acrylic resins and reactive polyamides to form a suitable crosslinkable thermosetting lacquer. The ratio of the first component to the second component is about 80:20 parts by weight to about 40:80 parts by weight, respectively. If desired, an organic solvent such as cellulose acetate butyrate or nitrocellulose solution may be used to dissolve the first and second lacquer components. The industrial screen ink lacquer of the transfer blocking overcoat layer is generally applied as a solution or dispersion in an organic solvent. Typically, the solvent constitutes about 10–80 parts by weight of the solution or dispersion. Acceptable solvents include alkyl, aryl and aralkyl ethers, aliphatic and aromatic hydrocarbons, as well as alkyl, aryl and aralkyl alcohols. Suitable lacquers are well known in the art and described, for example, in U.S. Pat. No. 3,959,555, U.S. Pat. No. 4,517,044, etc. Some industrial screen ink lacquers are available in the IL-000 series (tradename) of Nazdar Company, Chicago, Ill. which contain about 25–45 wt. % 2-butoxyethanol, 0–35 wt. % pigments, 10–20 wt. % resin material, 5–10 wt. % isopropanol, 0–16 wt. % petroleum distillates containing aromatic hydrocarbons, 0–6 wt. % crystalline silica, less than 4 wt. % toluene and 0–2 wt. % naphthalene.

Other non-limiting examples of the transfer blocking overcoat include, UVitec Aliphatic Coating (18846-87), UVitec Aromatic Coating (18955-87), UVitec Aliphatic Coating (18954-87), Sun Chemical UV RCF01498R, Epoxy Acryalate Varnish (INTER/UV-KOTE) by International Ink Company, and Cationic UV Overprint Varnishes (UCB Radcure Formulation). The INTER/UV-KOTE by International Ink Company is a clear to light amber colored viscous liquid having a specific gravity of less than 1.2. Preferred formulations are UVitec Aliphatic Coating (18846-87) and Sun Chemical UV RCF01498R.

The transfer blocking overcoats of the present invention may have a range of UV activated crosslinking concentrations of from about 0.01% to 20% by weight. For example, the Sun Chemical UV may have additional added photoinitiator and monomer at concentrations from 0.01% to 20% by weight.

The transfer blocking overcoat layer of the present invention may be applied with a screen size from 110 to 375 mesh, preferably 350 mesh. The transfer blocking overcoat layer is applied with a dry coat weight of 5 to 50 g/m$^2$, preferably 12 g/m$^2$. These coatings are applied by screen printing but could be applied by other methods (i.e., gravure, air knife, metered rod, etc.) with the coat weights above.

In another embodiment of the present invention, the transfer blocking overcoat layer is not applied. Therefore, the transfer sheet contains only a support, an optional barrier layer, an optional antistatic layer, at least one release layer, an image receiving layer, an image layer and an optional non-water-dispersible polymer layer. The non-water-dispersible polymer layer may cover the entire image layer or only the imaged areas or selected image areas.

Application of Layers

The various layers of the transfer material are formed by known coating techniques, such as by curtain coating, Meyer rod, roll, blade, air knife, cascade and gravure coating procedures.

The first layer to be coated on the support is the optional barrier layer. The barrier layer, if present, is followed by the release layer, followed by the image receiving layer, followed by the image layer, followed by the optional non-water dispersible polymer layer, followed by the optional transfer blocking overcoat layer.

In referring to FIG. 1, there is generally illustrated a cross-sectional view of one embodiment of the transfer sheet of the present invention. The support 21 comprises a top and bottom surface. The optional barrier layer 22 is coated onto the top surface of the support 21. The heat release layer 23 is then coated onto the optional barrier layer 22. The image receiving layer 24 is coated on top of the heat release layer 23. The image layer 25 is coated on top of the image receiving layer 24. The image layer 25 contains both image areas 26 and non-image areas 27. The optional non-water-dispersible polymer layer 28 is coated on top of the image layer 25. The optional transfer blocking overcoat layer 29 is coated on top of the optional non-water-dispersible polymer layer 28, such that the optional transfer blocking overcoat layer 29 outlines one or more of the image areas 26 present in the image layer 25. The antistatic agent may optionally be applied to the non-coated side of the support as an optional antistatic layer 30.

Figure 2:
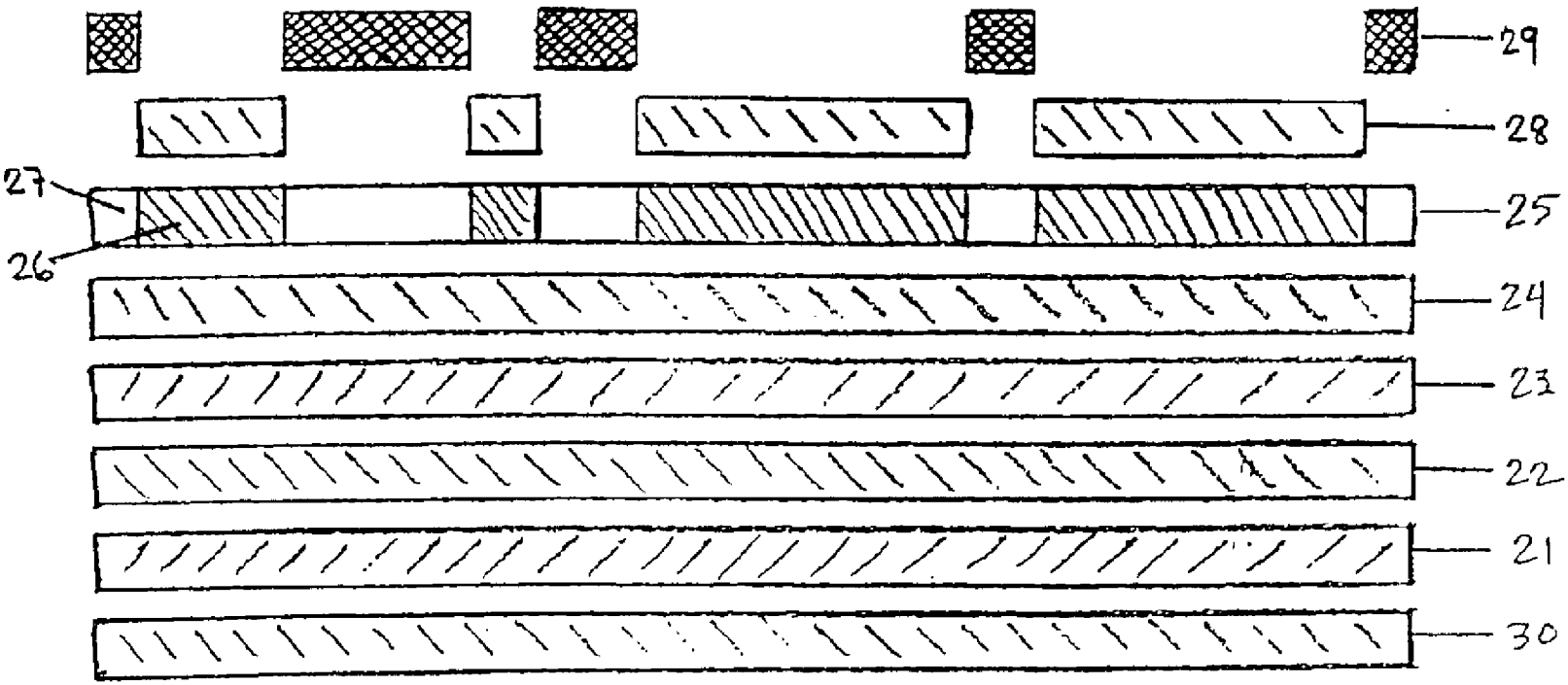
FIG. 2 is a cross-sectional view of another embodiment of the transfer element of the present invention.

In referring to FIG. 2, there is generally illustrated a cross-sectional view of one embodiment of the transfer sheet of the present invention. The support 21 comprises a top and bottom surface. The optional barrier layer 22 is coated onto the top surface of the support 21. The heat release layer 23 is then coated onto the optional barrier layer 22. The image receiving layer 24 is coated on top of the heat release layer 23. The image layer 25 is coated on top of the image receiving layer 24. The image layer 25 contains both image areas 26 and non-image areas 27. The optional non-water-dispersible polymer layer 28 is coated on top of one or more of the image areas 26 of the image layer 25. The optional transfer blocking overcoat layer 29 is coated on top of the non-image areas 27 of the image layer 25, such that the optional transfer blocking overcoat layer 29 outlines one or more of the image areas 26 present in the image layer 25. The antistatic agent may optionally be applied to the non-coated side of the support as an optional antistatic layer 30.

B. Receptor Element

The receptor or receiving element receives the transferred image. A suitable receptor includes but is not limited to textiles including cotton fabric, and cotton blend fabric. The receptor element may also include glass, metal, wool, plastic, ceramic or any other suitable receptor. Preferably the receptor element is a tee shirt or the like.

The image, as defined in the present application may be applied in any desired manner. For example, the image may be formed by a color or monochrome laser printer, laser copier, bubblejet printer, inkjet printer, and the like.

To transfer the image, the imaged transfer element is placed image side against a receptor element. A transfer device (i.e., a hand iron or a conventional pneumatic heat press) is used to apply heat to the substrate which in turn releases the image. The temperature transfer range of the hand iron is generally in the range of 110 to 220° C. with about 190° C. being the preferred temperature. The pneumatic heat press operates at a temperature transfer range of 100 to 220° C. with about 190° C. being the preferred temperature.

The transfer device is placed over the non-image side of the support and moved in a circular motion (hand iron only). Pressure (i.e., typical pressure applied during ironing) must be applied as the heating device is moved over the support (see FIG. 3). After about two minutes to five minutes (with about three minutes being preferred) using a hand iron and 10 seconds to 50 seconds using a heat press (with about twenty seconds being preferred) of heat and pressure, the transfer device is removed from the support. The transfer material is optionally allowed to cool from one to five minutes. The support is then peeled away from the image which is adhered to the receptor.

Figure 3:
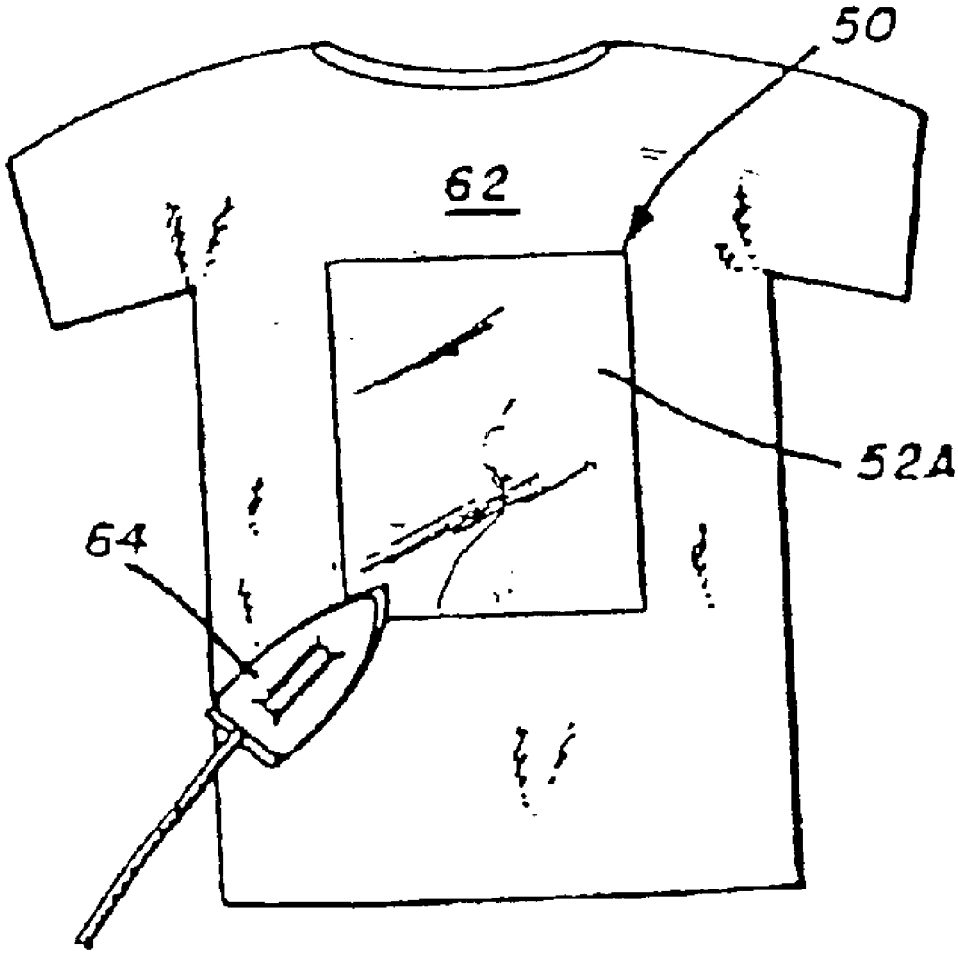

Referring to FIG. 3, the method of applying an image to a receptor element will be described. More specifically, FIG. 3 illustrates how the step of heat transfer from the transfer sheet 50 to a tee shirt or fabric 62 is performed. A tee shirt 62 is laid flat, as illustrated, on an appropriate support surface, and the imaged surface of the transfer sheet 50 is positioned onto the tee shirt. An iron 64 set at its highest heat setting is run and pressed across the back 52A of the transfer sheet. The image is transferred to the tee shirt and the transfer sheet is removed and discarded.

In a preferred embodiment, the method of ironing as described in co-pending application Ser. No. 09/453,881, which is herein incorporated by reference, can be used.

Additional Additives

Any of the layers of the transfer material may further comprise an additive capable of emitting radiation within the visible light spectrum. The preferred layers for this additive are the release layer and the image receiving layer, most preferably the release layer. For example, this additive may be organic, inorganic and/or organometallic compounds that have a quantum yield for fluorescence in the range of from 0.001 to 1.0. Alternatively, the additive may be organic, inorganic and/or an organometallic compounds that have a quantum yield for phosphorescence in the range of from 0.001 to 1.0. These additive systems may have radiative lifetimes of at least one nanosecond.

Examples of a suitable inorganic compound include those derived from lanthamide, alkali earth or transition metals which are reacted with elements of groups four, five or six of the Periodic Table. Additional examples of suitable inorganic compounds include those derived from members of the alkali earth or transition metals which are reacted with sulfur, thereby producing a luminescent sulfide complex. Examples of luminescent sulfide complexes include luminescent pigments such as zinc sulfide, copper sulfide, strontium sulfide or combinations thereof.

Examples of a suitable organic compound include aromatic and polycyclic aromatic compounds, such as coumarin, rhodamine, fluorescein and their derivatives, as well as 2,5-diphenyloxazole and 1,4-Bis(5-phenyloxazol-2-yl)benzene. Fluorescein derivatives and isomers may be the sodium salt forms, fluoresceinamine, diacetate and isothiocyanate. Coumarin isomers and derivatives include Coumarin-1, Coumarin-4, Coumarin-6, Coumarin-7, Coumarin-120, Coumarin-152, Coumarin-314, Coumarin-334, Coumarin-337, Coumarin-343 and carboxylated isomer derivatives. Rhodamine isomers and derivatives include rhodamine-123, rhodamine-B, rhodamine-B isocyanate, rhodamine-6G, rhodamine-6G perchlorate, rhodamine-6G tetrafluoroborate and rhodamine-110. The lactone derivatives of each of these may also be used.

Other systems include azo dyes such as CI Direct Yellow 86, CI Acid Red 249 and CI Direct Blue 199. Member dyes from the meracyanine, carbocyanine, indolene, imidazol, thiozole and oxazole class of compounds may also be selected. Organometallic systems may include metal containing substituted porphyrins, such as phthalocyanine complexed with members of the transition groups 6B, 8B, 1B and 2B. Porphyrin systems, such as Mesoporphyrin IX, complexed with the same transition element groups may also be selected.

The additives capable of emitting radiation within the visible light spectrum may be present at concentrations in the range of from 0.05% to 80%, preferably 0.05% to 20%, and most preferably 0.05% to 10% by dry weight.

The following examples are provided for a further understanding of the invention, however, the invention is not to be construed as limited thereto.

EXAMPLES

Example 1

In one embodiment of the invention, the barrier layer is a vinyl acetate polymer. An example of this embodiment is Barrier Layer Formulation 1:

Barrier Layer Formulation 1

| Components | Parts |
|---|---|
| Vinyl acetate-dibutyl maleate polymer dispersion (such as EVERFLEX G, Hampshire Chemical Corporation) | 50 parts |
| Water | 50 parts. |

Barrier Layer Formulation 1 may be prepared as follows: fifty parts of a vinyl acetate-dibutyl maleate polymer dispersion are combined with fifty parts of water by gentle stirring. The stirring is continued for approximately ten minutes at a moderate stir rate (up to but not exceeding a rate where cavitation occurs). The amount of water added may vary. The only limitation is that sufficient water is added to make the dispersion coatable on the substrate.

Example 2

An example of the PMMA-containing barrier layer is Barrier Layer Formulation 2:

Barrier Layer Formulation 2

| Components | Parts |
|---|---|
| Acetone 99.5% | 40 parts (weight) |
| 2-Propanol 99.5% | 40 parts (weight) |
| PMMA | 20 parts (weight). |

Barrier Layer Formulation 2 may be prepared as follows: The acetone and 2-propanol are weighed and mixed. The mixture is stirred. One half of the PMMA is added to the mixture while the mixture is heated to about 25° C. and stirring continues until the PMMA is dispersed. At this point, stirring continues until the remainder of the PMMA is added to the mixture and is dispersed. The mixture is then allowed to cool to room temperature.

Example 3

Another example of the barrier layer of the present invention is Barrier Layer Formulation 3:

| Compound | Chemical Class | General (parts by mass) | Preferably (parts by mass) | Most Preferably (parts by mass) |
|---|---|---|---|---|
| Uvacure 1500[a] | Cycloaliphatic epoxide | 10.0–60.0 | 20.0–50.0 | 30.0–40.0 |
| Uvacure 1562[b] | Cycloalipahtic epoxy resin | 40.0–0.0 | 30.0–10.0 | 25.0–15.0 |
| DEN 431[c] | Epoxy novolac resin | 5.0–30.0 | 10.0–20.0 | 12.0–18.0 |
| 2-propanol | Alcohol | 44.4–0.0 | 38.3–12.4 | 30.8–21.7 |
| Uvacure 1590[a] | Activated epoxy | 0.5–7.0 | 1.5–6.0 | 2.0–4.0 |
| Ebecryl BPO[a] | aryl ketone | 0.1–1.0 | 0.2–0.6 | 0.2–0.5 |
| BYK 354[c] | Polyacrylate | 0.0–1.0 | 0.0–0.5 | 0.0–0.4 |
| BYK 088[c] | Polysiloxane | 0.0–1.0 | 0.0–0.5 | 0.0–0.4 |

[a]UCB Chemical Corporation—Radcure Business Unit
[b]Dow Chemicals
[c]BYK Chemie Barrier Layer Formulation 3 is prepared as follows: DEN 431, an extremely viscous material, is placed into a beaker first, followed by 2-propanol. The remaining compounds are added in the order in which they appear listed in the table. Manual agitation may be required especially because of the extreme viscosity of DEN 431. Once mechanical agitation is used, the mixture is stirred for about 30–60 minutes at a rate just below the point where cavitation would have occurred.

Example 4

A barrier layer comprising Barrier Layer Formulation 3 is cured as follows: a thin film of barrier layer formulation 1, in the range of 1.0 g/m$^2$ to 20 g/m$^2$, is applied to a support and cured at <50 mJ/cm$^2$ with a mercury vapor ultraviolet lamp.

Example 5

Example 4 is repeated, and after UV curing, the film is further cured at temperatures between 60° C. and 200° in a heat chamber for 1 to 45 minutes.

Example 6

This example relates to a release layer formulation, Release Layer Formulation 1:

Release Layer Formulation 1

| Components | Parts by weight |
|---|---|
| Ethylene Acrylic Acid Co-polymer Dispersion (Michem Prime 4983R, Michelman) | 86 parts |
| Elastomeric emulsion (Hystretch V-29, BFGoodrich) | 5 parts |
| Polyurethane Dispersion (Daotan VTW 1265, Vianova Resins) | 4 parts |
| Polyethylene Glycol (Carbowax Polyethylene Glycol 400, Union Carbide) | 4 parts |
| Polyethylene Glycol Mono ((Tetramethylbutyl) Phenol) Ether (Triton X-100, Union Carbide) | 1 part |

Release Layer Formulation 1, as an embodiment of the invention suitable for laser copiers and laser printers, is wax free. Release Layer Formulation 1 may be prepared as follows: five parts of the elastomer dispersion are combined with eighty-six parts of an ethylene acrylic acid co-polymers dispersion by gentle stirring to avoid cavitation. Four parts of a polyurethane dispersion are then added to the mixture. Immediately following the addition of a polyurethane dispersion, four parts of a polyethylene glycol and one part of an nonionic surfactant (e.g., Triton X-100) are added. The entire mixture is allowed to stir for approximately fifteen minutes at a moderate stir rate (up to but not exceeding a rate where cavitation occurs). Once thoroughly combined, the mixture is filtered (for example, through a 53 $\mu$m nylon mesh).

Example 7

This example relates to another release layer formulation, Release Layer Formulation 2.

Release layer Formulation 2

| Components | Parts |
|---|---|
| Ethylene Acrylic Acid Co-polymers dispersion (Michem Prime 4938R, Michelman) | 74 parts (weight) |
| Wax Dispersion (Michelman 73635M, Michelman) | 25 parts (weight) |
| Retention Aid (Hercobond 2000, Hercules) | 1 part (weight) |

Formulation 2 works in a laser printer or copier despite the presence of wax since the wax is present in sufficiently low amounts so as to not adversely affect imaging such as, for example, by melting within the printer or copier (i.e., at most about 25 parts (weight)).

Formulation 2 may be prepared in the following manner: the ethylene acrylic acid co-polymer dispersion and the wax dispersion are stirred (for example in a beaker with a stirring bar). The retention aid is added, and the stirring continues until the retention aid is completely dispersed.

In another embodiment of the invention, the above-described release layer is divided into two separate layers. An example of this embodiment is a layer comprising ethylene acrylic acid that allows release or separation. An elastomer and polyurethane of the present invention, as well as any additives discussed above, are combined in a second layer that provides the above-described transfer qualities.

Example 8

This example relates to a PCC-containing image receiving layer formulation, PCC-containing Image Receiving Layer Formulation 1:

PCC-containing Image Receiving Layer Formulation 1

| Components | Parts (by weight) |
|---|---|
| Ethylene Acrylic Acid Co-polymers Dispersion (Michem Prime 4983R, 4990, 4983R-HS, or 4983-40R by Michelman) | 30 parts |
| Elastomeric latex emulsion (Hystretch V-29, BF Goodrich) | 5 parts |
| Polyvinyl Alcohol, 7% solution (Airvol 107 by Air Products) | 30 parts |
| Precipitated Calcium Carbonate (JETCOAT 30, Specialty PCC, Specialty Minerals) | 35 parts |

Alternatively, the binders suitable for Release Layer Formulation 1 may be used in lieu of the above-described ethylene acrylic acid copolymer dispersion.

PCC-containing image release layer formulation 1 is prepared by mixing each of the constituents until cavitation does not occur. The order of mixing is not important.

Example 9

This example relates to is another PCC-containing image receiving layer formulation, PCC-containing Image Receiving Layer Formulation 2:

PCC-containing Image Receiving Layer Formulation 2

| Compound | Parts (by weight) |
|---|---|
| Precipitated Calcium Carbonate (JETCOAT 30, Specialty PCC, Specialty Minerals) | 93 parts |
| Cationic Polymer (OSC-470) | 2 parts |
| Emulsion of wax, melamine, and fluorochemical polymer (Freepel, FX-1202,) | 5 parts |

PCC-containing image release layer formulation 2 is prepared by mixing each of the constituents until cavitation does not occur. The order of mixing is not important.

Example 10

This example relates to two PVP-containing image receiving layer formulations, PVP-containing Image Receiving Layer Formulations 1 and 2:

PVP-containing Image Receiving Layer Formulation 1

| Compound | Parts (by weight) |
|---|---|
| Water | 58 |
| PVP (Luvicross M, crosslinked PVP by BASE) | 22 |
| Copolymer dispersion (Michem Prime 4983R, by Michelman) | 13 |
| Elastomeric Latex Emulsion (Hystretch V-29, by BF Goodrich) | 2 |
| Polyurethane Dispersion (Daotan VTW-1265, by Vianova) | 3 |
| Polyethylene Glycol (Carbowax PEG-400, By Union Carbide) | 2 |

PVP-containing Image Receiving Layer Formulation 2

| Compound | Parts (by weight) |
|---|---|
| Water | 75.89 |
| Fluoroalkyl alcohol (Zonyl FSD, by DuPont) | 0.05 |
| PVP (Luvicross M, crosslinked PVP by BASF) | 13.07 |
| Modified Cellulose (Celquat L-200, Cationically Modified Cellulose by National Starch) | 0.13 |
| Polyethylene glycol (RITA PEO-2, by RITA Corp.) | 0.16 |
| Fatty Amide (Tanasoft HCA, quaternized Diethylsulfate fatty amide by Sybron Chemicals, Inc.) | 8.26 |
| Epi-amine (Reten 201, by Hercules) | 2.35 |
| Silicone Emulsion (Antifoam 1520, by Dow Corning) | 0.09 |

PVP-containing image release layer formulations 1 and 2 are prepared by adding the Antifoam 1520 to the water then slowly incorporating the Luvicross M into the water mixture with stirring. Once the addition of the Luvicross M is complete, the other components are added with stirring to the point where no cavitation occurs. The order of mixing the additional components is not important.

Example 11

This example relates to is a PCC/PVP-containing image receiving layer formulation, PVP-containing Image Receiving Layer Formulation 1:

PCC/PVP-containing Image Receiving Layer Formulation 1

| Compound | Parts (by weight) |
|---|---|
| Water | 29 |
| PCC (JETCOAT 30, Specialty PCC, by Specialty Minerals) | 52 |
| PVP (Luvicross M, crosslinked PVP by BASF) | 11 |
| Emulsion of wax, melamine, and Fluorochemical polymer (Freepel FX-1202, by BF-Goodrich) | 6 |
| Cationic Polymer (OSC-470, by Ontario Specialty Coatings) | 2 |

PCC/PVP-containing image release layer formulation 1 is prepared by slowly incorpating the Luvicross M into the water with stirring. Once the addition of the Luvicross M is complete, the other components are added with stirring to the point where no cavitation occurs. The order of mixing the additional components is not important.

Example 12

A transfer sheet according to the present invention is prepared as follows:

A paper support is coated with a barrier layer of Barrier Layer Formulation 1. A heat release layer of Heat Release Layer Formulation 1 is then applied on top of the barrier layer. A PCC-containing image receiving layer of PCC-containing Image Receiving Layer Formulation 1 is then applied on top of the heat release layer. The following table can be used as a guide to determine optimum coating weights and thickness of the Barrier, Release and PCC-containing Image Receiving Layers:

Coat Weights and Thickness

| | Parts | Wet Coat ($g/m^2$) | Dry Coat ($g/m^2$) | Thickness (mil) |
|---|---|---|---|---|
| Barrier Layer | 50 | 28 | 2 to 20 | 0.05 to 0.80 |
| Release Layer | 95 | 96.2 | 12 to 50 | 0.48 to 2.00 |
| PCC-Containing Image Receiving Layer | 100 | 20 | 1 to 40 | 0.01 to 5 |

Next, an image is formed on the PCC-containing image receiving layer by means of an ink jet printer.

The transfer of the image area from the image transfer sheet is completed by placing a 100% cotton shirt into a hard surface, applying heat and pressure from a conventional iron set on its highest temperature setting for a time sufficient to transfer the image area to the shirt (e.g. 3–5 minutes) and then removing the printed shirt from the hard surface. The fused expended transfer sheet is manually removed from the shirt to provide a printed shirt having excellent hand and a clear printed image.

Example 13

Example 12 is repeated with the exception of replacing of PCC-containing Image Receiving Layer Formulation 1 with of PCC-containing Image Receiving Layer Formulation 2.

Example 14

A transfer sheet according to the present invention is prepared as follows:

A paper support is coated with a barrier layer of Barrier Layer Formulation 1. A heat release layer of Heat Release Layer Formulation 1 is then applied on top of the barrier layer. A PCC-containing image receiving layer of PVP-containing Image Receiving Layer Formulation 1 is then applied on top of the heat release layer. The following table can be used as a guide to determine optimum coating weights and thickness of the Barrier, Release and PVP-containing Image Receiving Layers:

| | Coat Weights and Thickness | | | |
|---|---|---|---|---|
| | Parts | Wet Coat ($g/m^2$) | Dry Coat ($g/m^2$) | Thickness (mil) |
| Barrier Layer | 50 | 28 | 2 to 20 | 0.05 to 0.80 |
| Release Layer | 95 | 96.2 | 12 to 50 | 0.48 to 2.00 |
| PVP-Containing Image Receiving Layer | 100 | 80 | 1 to 100 | 0.05 to 2.00 |

Next, an image is formed on the PVP-containing image receiving layer by means of an ink jet printer.

The transfer of the image area from the image transfer sheet is completed by placing a 100% cotton shirt into a hard surface, applying heat and pressure from a conventional iron set on its highest temperature setting for a time sufficient to transfer the image area to the shirt (e.g. 3–5 minutes) and then removing the printed shirt from the hard surface. The fused expended transfer sheet is manually removed from the shirt to provide a printed shirt having excellent hand and a clear printed image.

Example 15

A transfer sheet according to the present invention is prepared as follows:

A paper support is coated with a barrier layer of Barrier Layer Formulation 1. A heat release layer of Heat Release Layer Formulation 1 is then applied on top of the barrier layer. A PCC-containing image receiving layer of PCC/PVP-containing Image Receiving Layer Formulation 1 is then applied on top of the heat release layer. The following table can be used as a guide to determine optimum coating weights and thickness of the Barrier, Release and PCC/PVP-containing Image Receiving Layers:

| | Coat Weights and Thickness | | | |
|---|---|---|---|---|
| | Parts | Wet Coat ($g/m^2$) | Dry Coat ($g/m^2$) | Thickness (mil) |
| Barrier Layer | 50 | 28 | 2 to 20 | 0.05 to 0.80 |
| Release Layer | 95 | 96.2 | 12 to 50 | 0.48 to 2.00 |

-continued

| | Coat Weights and Thickness | | | |
|---|---|---|---|---|
| | Parts | Wet Coat ($g/m^2$) | Dry Coat ($g/m^2$) | Thickness (mil) |
| PCC/PVP-Containing Image Receiving Layer | 100 | 90 | 2 to 100 | 0.05 to 2.00 |

Next, an image is formed on the PCC/PVP-containing image receiving layer by means of an ink jet printer.

The transfer of the image area from the image transfer sheet is completed by placing a 100% cotton shirt into a hard surface, applying heat and pressure from a conventional iron set on its highest temperature setting for a time sufficient to transfer the image area to the shirt (e.g. 3–5 minutes) and then removing the printed shirt from the hard surface. The fused expended transfer sheet is manually removed from the shirt to provide a printed shirt having excellent hand and a clear printed image.

Example 16

This example relates to a transfer blocking overcoat layer formulation (all % are % by weight based on the total weight of the formulation).

| Formulation A | |
|---|---|
| Eb 745 | 50% |
| OTA-480 | 40% |
| Eb P115 | 4% |
| Eb BPO | 5% |
| PA 11 | 0.5% |
| Byk 344 | 0.5% |

Eb 745 is an acrylic oligomer, OTA-480 is a propoxylated glycerol triacrylate monomer, Eb P115 is an amine-functional acrylate additive, Eb BPO is benzophenone, PA 11 is a photoinitiator, and Byk is a silicone additive. All components are products of UCB-Radcure, except for Byk 344 which is a product of BYK Chemie (USA). Formulation A is prepared by mixing the above-listed components in their listed order under gentle stirring.

Example 17

This example relates to another transfer blocking overcoat layer formulation (all % are % by weight based on the total weight of the formulation).

| Formulation B | |
|---|---|
| Eb 3600 | 18% |
| DPHPA | 15% |
| HDODA | 7% |
| Eb 350 | 0.5% |
| Eb BPO | 7% |
| Tego Airex | 0.5% |

Eb 3600 is an imine-modified Bisphenol A epoxy acrylate resin, DPHPA is an acrylated dipentaerythritol, HDODA is a 1,6-hexanediol diacrylate, Eb 350 is an acrylated silicone, Eb BPO is benzophenone. All components are products of UCB-Radcure, except for Tego Airex which a product of Tego Chemie Service (USA). Formulation B is prepared by mixing the above-listed components in their listed order under gentle stirring.

Example 18

This Example demonstrates the image transfer procedure. Referring to FIG. 3, to transfer the image, (1) the support 21 is placed image side against a receptor (tee shirt) of the present invention. The receptor of this example includes but is not limited to cotton fabric, cotton blend fabric, glass and ceramic. A transfer device of the present invention (i.e., a hand iron or heat press) is used to apply heat to the substrate second surface of the support, which in turn releases the image areas 26. The temperature of the hand iron is about 190° C. The heat press operates at a temperature transfer range of about 190° C. (2) The transfer device is placed over the second surface of the support 21 and moved in a circular motion (if the hand iron is used). Usual pressure applied when ironing is applied as the heating device is moved over the support 21. After about 180 seconds (15 seconds if using the heat press) of heat and pressure, the transfer device is removed from the support 21. The support 21 is allowed to cool for about five minutes. (3) The support 21 is then peeled away from the receptor.

Example 19

This example relates to another method of applying an image to a receptor element will be described. More specifically, FIG. 3 illustrates how the step of heat transfer from the transfer sheet 50 to a tee shirt or fabric 62 is performed.

The transfer sheet is prepared as described in the Example 13. A tee shirt 62 is laid flat, as illustrated, on an appropriate support surface, and the image surface of the transfer sheet 50 is positioned onto the tee shirt. An iron 64 set at its highest heat setting is run and pressed across the back 52A of the transfer sheet. The image and non-image areas are transferred to the tee shirt and the transfer sheet is removed and discarded.

Example 20

A transfer sheet of the present invention is prepared according to Example 13, however, the image layer is applied with a conventional laser copier.

The resulting image is transferred as in Example 18, above.

Example 21

Example 13 is repeated, except that once the PCC-containing image receiving layer has completely dried, the following antistatic layer is coated on the backside of the support (the previously non-coated side).

| Antistatic Layer Solution Formulation 1 | |
|---|---|
| Water | 90 parts (by weight) |
| Quaternary ammonium salt solution (Statik-Blok J-2, Amstat Industries) | 10 parts (by weight) |

The antistatic solution is applied in a long line across the top edge of the substrate using a #4 metering rod. The coated support is force air dried for approximately one minute.

The antistatic solution of this Example has the following characteristics: the solution viscosity as measured on a Brookfield DV-I+ viscometer, LV1 spindle @ 60 RPM is 2.0 (cP) at 24.5° C. The coating weights (wet) are 10 to 20 g/m$^2$. The surface tension is 69.5 dynes/cm at 24° C.

Once the support and antistatic coating are dry, the coated transfer sheet is placed into an electrostatic printer and imaged upon.

Example 22

Example 21 is repeated, except that following formulation is used as the antistatic layer and is coated on the backside of the substrate (the previously non-coated side):

| Antistatic Layer Solution Formulation 2 | |
|---|---|
| Water | 95 parts (by weight) |
| Polyether (Marklear ALF-23, Witco Ind.) | 5 parts (by weight) |

Example 23

This example relates to a release layer formulation wherein Release Layer Formulation 1 formulated with precipitated calcium carbonate. This new release layer formulation is then coated over a support already having a barrier layer coated thereon.

| 77% Precipitated Calcium Carbonate Composition | |
|---|---|
| Component | Weight (g) |
| Calcium Acetate (Aldrich Chemical) | 15 |
| Sodium Carbonate (Aldrich Chemical) | 15.8 |
| Release Layer Formulation 1 | 66 |

Sixty-six grams of Release Layer Formulation 1 is enough material to coat about one (1) meter square of support once the salt precipitation reaction is brought to completion. Fifteen grams (15 g) of Calcium Acetate is dissolved into about 10 grams of Release Layer Formulation 1. Fifteen and eight tenths (15.8 g) grams of Sodium Carbonate is dissolved into 56 grams of Release Layer Formulation One under gentle stirring. Under condition of rapid stirring, the 10 grams of the Calcium Acetate containing Release Layer Formulation 1 is rapidly injected into the 56 grams of Sodium Carbonate-containing Release Layer Formulation 1. After a reaction time of five (5) seconds, the solution is coated onto Barrier Formulation 1 coated support using a #30 metered rod. The coating is force air dried prior to ink jet printing.

All cited patents, publications, copending applications, and provisional applications referred to in this application are herein incorporated by reference.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An image transfer sheet, comprising:

a support sheet having a first and a second surface;

at least one release layer on said first surface of said support sheet; and an image receiving layer on said at least one release layer, wherein said image receiving layer is selected from the group consisting of 1) a precipitated calcium carbonate (PCC)-containing image receiving layer, comprising:
precipitated calcium carbonate, and optionally
a binder, and 2) a precipitated calcium carbonate/polyvinylpyrrolidone (PCC/PVP)-containing image receiving layer, said layer comprising:
precipitated calcium carbonate,
polyvinylpyrrolidone, and optionally
a binder.

2. The image transfer sheet according to claim 1, which further comprises a barrier layer between the first surface of said support sheet and said release layer.

3. The image transfer sheet according to claim 1, which further comprises an image layer on said image receiving layer, said image layer comprising image areas.

4. The image transfer sheet according to claim 3, wherein said image layer comprises dye combinations wherein the dyes in the combination participate in radiation transfer.

5. The image transfer sheet according to claim 1, which further comprises an antistatic layer on the second surface of said support sheet.

6. The image transfer sheet according to claim 1, wherein said image receiving layer is said PCC-containing image receiving layer.

7. The image transfer sheet according to claim 6, wherein said PCC-containing image receiving layer comprises:

about 20 to about 100% by weight of said precipitated calcium carbonate, based on total weight of the image receiving layer, and about 0 to about 80% by weight of said binder, based on the total weight of the image receiving layer.

8. The image transfer sheet according to claim 7, wherein said PCC-containing image receiving layer comprises:

about 50 to about 95% by weight of said precipitated calcium carbonate, based on total weight of the image receiving layer, and about 5 to about 50% by weight of said binder, based on the total weight of the image receiving layer.

9. The image transfer sheet according to claim 1, wherein said image receiving layer is said PCC-containing image receiving layer having a dry coat weight of about 1 to about 40 g/m$^2$.

10. The image transfer sheet according to claim 9, wherein said PCC-containing image receiving layer has a dry coat weight of about 1 to about 40 g/m$^2$.

11. The image transfer sheet according to claim 10, wherein said PCC-containing image receiving layer has a dry coat weight of about 1 to about 10 g/m$^2$.

12. The image transfer sheet according to claim 1, wherein said image receiving layer is said PCC-containing image receiving layer having a dry coat thickness of about 0.01 to about 5 mils.

13. The image transfer sheet according to claim 12, wherein said PCC-containing image receiving layer has a dry coat thickness of about 0.01 to about 2 mils.

14. The image transfer sheet according to claim 13, wherein said PCC-containing image receiving layer has a dry coat thickness of about 0.1 to 1.5 mils.

15. The image transfer sheet according to claim 1, wherein said image receiving layer is said PCC/PVP-containing image receiving layer.

16. The image transfer sheet according to claim 15, wherein said PCC/PVP-containing image receiving layer comprises:

about 0.1 to about 95% by weight of said precipitated calcium carbonate, based on the total weight of the image receiving layer, about 5 to about 99.9% by weight of said polyvinylpyrrolidone, based on total weight of the image receiving layer, and about 0 to about 80% by weight of said binder, based on the total weight of the image receiving layer.

17. The image transfer sheet according to claim 16, wherein said PCC/PVP-containing image receiving layer comprises:

about 5 to about 85% by weight of said precipitated calcium carbonate, based on the total weight of the image receiving layer, about 10 to about 95% by weight of said polyvinylpyrrolidone, based on total weight of the image receiving layer, and about 5 to about 40% by weight of said binder, based on the total weight of the image receiving layer.

18. The image transfer sheet according to claim 17, wherein said PCC/PVP-containing image receiving layer comprises:

about 30 to about 70% by weight of said precipitated calcium carbonate, based on the total weight of the image receiving layer, about 20 to about 85% by weight of said polyvinylpyrrolidone, based on total weight of the image receiving layer, and about 5 to about 25% by weight of said binder, based on the total weight of the image receiving layer.

19. The image transfer sheet according to claim 1, wherein said image receiving layer is said PCC/PVP-containing image receiving layer having a dry coat weight of about 1 to about 100 g/m$^2$.

20. The image transfer sheet according to claim 19, wherein said PCC/PVP-containing image receiving layer has a dry coat weight of about 2 to about 50 g/m$^2$.

21. The image transfer sheet according to claim 20, wherein said PCC/PVP-containing image receiving layer has a dry coat weight of about 2 to about 30 g/m$^2$.

22. The image transfer sheet according to claim 20, wherein said image receiving layer is said PCC/PVP-containing image receiving layer having a dry coat thickness of about 0.05 to about 2 mils.

23. The image transfer sheet according to claim 20, wherein said PCC/PVP-containing image receiving layer has a dry coat thickness of about 0.1 to about 2.0 mils.

24. The image transfer sheet according to claim 23, wherein said PCC/PVP-containing image receiving layer has a dry coat thickness of about 0.2 to about 1.5 mils.

25. The image transfer sheet according to claim 1, wherein said release layer comprises an additive capable of emitting radiation within the visible light spectrum.

26. An image transfer sheet comprising:

a support sheet having a first and a second surface;

at least one release layer on said first surface of said support sheet;

an image receiving layer on said at least one release layer, wherein said image receiving layer is selected from the group consisting of 1) a precipitated calcium carbonate (PCC)-containing image receiving layer, 2) a polyvinylpyrrolidone (PVP)-containing image receiving layer, and 3) an image receiving layer which comprises both PCC and PVP (PCC/PVP);

an image layer on said image receiving layer, said image layer comprising image areas;

a non-water-dispersible polymer layer on said image layer; and a transfer. blocking overcoat layer on said non-water-dispersible polymer layer, wherein said transfer blocking overcoat layer outlines at least one imaged area or selected imaged areas in said image layer, but does not cover said image area within the outline, wherein said transfer blocking overcoat layer allows transfer of only said release layer, said image areas of the image layer and said non-water-dispersible polymer layer within said outlined image area.

27. The image transfer sheet according to claim 26, wherein said image receiving layer is said PVP-containing image receiving layer, which layer comprises:

polyvinylpyrrolidone, and optionally a binder.

28. The image transfer sheet according to claim 27, wherein said PVP-containing image receiving layer comprises:

about 20 to about 100% by weight of said polyvinylpyrrolidone, based on total weight of the image receiving layer, and about 0 to about 80% by weight of said binder, based on the total weight of the image receiving layer.

29. The image transfer sheet according to claim 28, wherein said PVP-containing image receiving layer comprises:

about 40 to about 90% by weight of said polyvinylpyrrolidone, based on total weight of the image receiving layer, and about 10 to about 60% by weight of said binder, based on the total weight of the image receiving layer.

30. The image transfer sheet according to claim 29, wherein said PVP-containing image receiving layer comprises:

about 75 to about 95% by weight of said polyvinylpyrrolidone, based on total weight of the image receiving layer, and about 5 to about 25% by weight of said binder, based on the total weight of the image receiving layer.

31. The image transfer sheet according to claim 26, wherein said image receiving layer is said PVP-containing image receiving layer having a dry coat weight of about 1 to about 100 g/m$^2$.

32. The image transfer sheet according to claim 31, wherein said PVP-containing image receiving layer has a dry coat weight of about 2 to about 50 g/m$^2$.

33. The image transfer sheet according to claim 32, wherein said PVP-containing image receiving layer has a dry coat weight of about 2 to about 30 g/m$^2$.

34. The image transfer sheet according to claim 26, wherein said image receiving layer is said PVP-containing image receiving layer having a dry coat thickness of about 0.05 to about 2 mils.

35. The image transfer sheet according to claim 34, wherein said PVP-containing image receiving layer has a dry coat thickness of about 0.1 to about 2.0 mils.

36. The image transfer sheet according to claim 35, wherein said PVP-containing image receiving layer has a dry coat thickness of about 0.1 to about 1.0 mils.

37. The image transfer sheet according to claim 26, wherein said image receiving layer is said PCC-containing image receiving layer, which layer comprises:

precipitated calcium carbonate, and optionally a binder.

38. The image transfer sheet according to claim 26, wherein said image receiving layer is said layer, which comprises both PCC and PVP (PCC/PVP), which layer comprises:

precipitated calcium carbonate, polyvinylpyrrolidone, and optionally a binder.

39. A process for heat transferring an imaged area from a transfer sheet to a receptor element, comprising the steps:

(a) providing an image transfer sheet, comprising:

a support sheet having a first and a second surface;

at least one release layer on said first surface of said support sheet; and an image receiving layer on said at least one release layer, wherein said image receiving layer is selected from the group consisting of 1) a precipitated calcium carbonate (PCC)-containing image receiving layer, comprising:

precipitated calcium carbonate, and optionally a binder, and 2) a precipitated calcium carbonate/polyvinylpyrrolidone (PCC/PVP)-containing image receiving layer, said layer comprising:

precipitated calcium carbonate, polyvinylpyrrolidone, and optionally a binder;

(b) applying an imge layer on said image receiving layer, said image layer comprising image areas;

(c) contacting said receptor element with the image layer of the image transfer sheet;

(d) applying heat and pressure to the second surface of the support sheet sufficient to transfer said image area to said receptor element to form an imaged receptor; and (e) removing said image transfer sheet from said imaged receptor.

40. The process according to claim 39, wherein said heat is applied at a temperature from about 110 to 220° C.

41. The process according to claim 39, wherein said release layer comprises an additive capable of emitting radiation within the visible light spectrum.

42. A process for heat transferring an imaged area from a transfer sheet to a receptor element, comprising the steps:

(a) providing an image transfer sheet, comprising:

a support sheet having a first and a second surface;

at least one release layer on said first surface of said support sheet;

an image receiving layer on said at least one release layer, wherein said image receiving layer is selected from the group consisting of 1) a precipitated calcium carbonate (PCC)-containing image receiving layer, 2) a polyvinylpyrrolidone (PVP)-containing image receiving layer, and 3) an image receiving layer which comprises both PCC and PVP (PCC/PVP);

an image layer on said image receiving layer, said image layer comprising image areas;

a non-water-dispersible polymer layer on said image layer; and a transfer blocking overcoat layer on said non-water-dispersible polymer layer, wherein said transfer blocking overcoat layer outlines at least one imaged area or selected imaged areas in said image layer, but does not cover said image area within the outline, wherein said transfer blocking overcoat layer allows transfer of only said release layer, said image areas of the image layer and said non-water-dispersible polymer layer within said outlined image area;

(b) contacting said receptor element with the transfer blocking overcoat layer of the image transfer sheet;

(c) applying heat and pressure to the second surface of the support sheet sufficient to transfer said image area to said receptor element to form an imaged receptor; and (d) removing said image transfer sheet from said imaged receptor.

* * * * *